US007870733B2

(12) United States Patent
Uno et al.

(10) Patent No.: US 7,870,733 B2
(45) Date of Patent: Jan. 18, 2011

(54) FLUID MACHINE FOR RANKINE CYCLE

(75) Inventors: Keiichi Uno, Kariya (JP); Hironori Asa, Okazaki (JP); Yasuhiro Takeuchi, Kariya (JP); Hiroshi Ogawa, Nagoya (JP); Hiroshi Kishita, Anjo (JP); Kazuhide Uchida, Hamamatsu (JP); Yasuhiro Kawase, Nishio (JP); Atsushi Inaba, Kariya (JP)

(73) Assignees: DENSO Corporation, Kariya (JP); Nippon Soken, Inc., Nishio (JP)

( * ) Notice: Subject to any disclaimer, the term of this patent is extended or adjusted under 35 U.S.C. 154(b) by 1025 days.

(21) Appl. No.: 11/641,202

(22) Filed: Dec. 18, 2006

(65) Prior Publication Data

US 2007/0175212 A1 Aug. 2, 2007

(30) Foreign Application Priority Data

| | | |
|---|---|---|
| Dec. 21, 2005 | (JP) | 2005-368519 |
| Jan. 17, 2006 | (JP) | 2006-009107 |
| Mar. 1, 2006 | (JP) | 2006-055380 |
| Sep. 21, 2006 | (JP) | 2006-256073 |
| Sep. 25, 2006 | (JP) | 2006-259437 |

(51) Int. Cl.
*F01K 13/02* (2006.01)

(52) U.S. Cl. ..... 60/646; 60/657

(58) Field of Classification Search ..... 60/646, 60/657

See application file for complete search history.

(56) References Cited

U.S. PATENT DOCUMENTS 3,937,022 A 2/1976 Swearingen
4,267,458 A * 5/1981 Uram et al. ..... 290/40 R
4,606,652 A * 8/1986 Swearingen ..... 384/130

(Continued)

FOREIGN PATENT DOCUMENTS

EP 0 050 959 5/1982

(Continued)

OTHER PUBLICATIONS

Office action dated Nov. 12, 2009 in corresponding German Application No. 10 2006 060435.0.

(Continued)

*Primary Examiner*—Hoang M Nguyen
(74) *Attorney, Agent, or Firm*—Harness, Dickey & Pierce, PLC

(57) ABSTRACT

It is an object to provide a fluid machine, which is simple in structure and in which lubricating oil containing smaller amount of the working fluid is supplied to sliding portions of an expansion device. The fluid machine has the expansion device for generating a driving force by expansion of the working fluid, which contains the lubricating oil and is heated to a gas phase condition. The fluid machine further has an electric power generating device driven by the driving force of the expansion device and generating electric power. An oil pooling portion is formed in a fluid passage, through which the working fluid discharged from the expansion device flows, such that the lubricating oil contained in the working fluid is brought into contact with at least one of sliding portions of the expansion device and the electric power generating device. And a heating unit is provided to heat the working fluid in the oil pooling portion.

9 Claims, 23 Drawing Sheets

U.S. PATENT DOCUMENTS

| | | | | |
|---|---|---|---|---|
| 4,617,808 | A | 10/1986 | Edwards | |
| 6,132,195 | A | 10/2000 | Ikoma et al. | |
| 6,409,488 | B1 | 6/2002 | Ikoma et al. | |
| 6,748,743 | B1 * | 6/2004 | Foster-Pegg | 60/646 |
| 2004/0144093 | A1 | 7/2004 | Hanna et al. | |
| 2004/0184923 | A1 | 9/2004 | Iwanami et al. | |
| 2005/0220642 | A1 | 10/2005 | Uno et al. | |

FOREIGN PATENT DOCUMENTS

| | | |
|---|---|---|
| JP | 58-032908 | 2/1983 |
| JP | 59-138707 | 8/1984 |
| JP | 05-079481 | 3/1993 |
| JP | 06-323271 | 11/1994 |
| JP | 10-141267 | 5/1998 |
| JP | 2000-297770 | 10/2000 |

OTHER PUBLICATIONS

Office action dated Oct. 26, 2010 in corresponding Japanese Application No. 2006-055380.

* cited by examiner

FLUID MACHINE FOR RANKINE CYCLE

CROSS REFERENCE TO RELATED APPLICATION

This application is based on Japanese Patent Application Nos. 2005-368519 filed on Dec. 21, 2005, 2006-9107 filed on Jan. 17, 2006, 2006-256073 filed on Sep. 21, 2006, 2006-259437 filed on Sep. 25, 2006, and 2006-55380 filed on Mar. 1, 2006, the disclosures of which are incorporated herein by reference.

FIELD OF THE INVENTION

The present invention relates to a fluid machine, which generally includes an expansion device arranged in Rankine cycle having waste heat of an internal combustion engine as its thermal source, an electrical power generating device driven by the expansion device to generate electrical power, and/or a pump for circulating working fluid in the Rankine cycle.

BACKGROUND OF THE INVENTION

It is known in the art, as disclosed in Japanese Patent Publication No. S58-32908, that an oil separating device is provided in a Rankine apparatus. A heat exchanger is provided in the oil separating device for supplying heat energy into an oil pooling portion, so that refrigerant melt in lubricating oil is vaporized. Then, the lubricating oil having a smaller amount of the refrigerant is supplied to an expansion device of the Rankine apparatus.

The above oil separating device is, however, independently provided from the expansion device. Accordingly, the structure for the Rankine apparatus becomes more complicated and connecting portions in the Rankine apparatus are increased. As a result, it is hard to apply the Rankine apparatus to a vehicle, in which mounting condition is strict.

Another fluid machine is known in the art, as disclosed in Japanese Patent Publication No. 2004-232492, in which a pomp-motor device (that is the expansion device, which is also used as a compressor) and an electric rotating device are integrally formed in a housing. According to the prior art fluid machine, the fluid machine is used such that an operating axis is arranged in a horizontal plane. A valve device is provided in the pump-motor device to switch over flow direction of working fluid, so that the pump-motor is operated either as the compressor device or as the expansion device. A low pressure port is provided in the housing at such a side position of the electric rotating device which is opposite to the pump-motor device. When the pump-motor device is operated as the expansion device, the working fluid discharged from the expansion device flows through the inside of the electric rotating device and flows out from the low pressure port.

The lubricating oil is generally mixed with the working fluid in the above fluid machine, so that sliding portions of the expansion device or the electric rotating device are lubricated by the lubricating oil. When the fluid machine is used in such a position that the electric rotating device is arranged at an upper side of the expansion device, the working fluid discharged from the expansion device flows from a lower side of the electric rotating device toward an upper side thereof, so that the working fluid flows out from the low pressure port. Accordingly, the lubricating oil is carried off from the low pressure port by the working fluid which is continuously discharged from the expansion device, even when the lubricating oil is separated from the working fluid within a space of the electric rotating device formed in the housing. Therefore, it is difficult to pool the lubricating oil at the lower portion of the space for the electric rotating device. Furthermore, the temperature of the working fluid at an outlet side of the expansion device is higher than that at an inlet side thereof. A larger amount of the working fluid is melt in the lubricating oil, to thereby decrease viscosity of the lubricating oil. As a result, a sufficient amount for a thickness of an oil film may be hardly obtained at the sliding portions.

According to another prior art, such as Japanese Patent Publication No. H5-79481, such a compressor or a pump device is also known as a fluid machine, according to which sucked working fluid is pressurized and pumped out. Namely, the compressor or the pump device of the fluid machine is a roller-type, wherein a roller (i.e. a cylindrical piston) is slidably provided on an eccentric shaft portion of a driving shaft, and the roller is moved in an orbital motion within a cylinder, so that the working fluid sucked into the cylinder is pressurized and pumped out. The lubricating oil is supplied to sliding surfaces between the eccentric shaft portion and the roller.

Both axial end portions of the eccentric shaft portion are formed as small diameter shaft portions, and annular seal members are provided at such positions, which are between an outer peripheral portion of a large diameter shaft portion and an inner peripheral surface of the roller and which are at both axial ends of the large diameter shaft portion, in order to prevent the lubricating oil from flowing into a working chamber of the cylinder. Small spaces are formed between the inner peripheral surface of the roller and the small diameter shaft portions, such that the small spaces receive a part of the working fluid leaking from the high pressure working chamber to a side of the sliding portions. At an initial stage of a suction stroke, the small spaces are communicated with a suction passage, so that the working fluid flows out from the small spaces into the suction passage.

In the fluid machine used as the liquid pump for circulating the working fluid in the Rankine cycle, it becomes harder to form the oil film at the sliding portions when the liquid phase working fluid of low viscosity flows into the sliding portions. Accordingly, it is necessary to supply the lubricating oil of the high viscosity to the sliding portions and to prevent the liquid phase working fluid from flowing into the sliding portions, in order to surely achieve good lubrication at the sliding portions.

When the above fluid machine is, for example, used as the liquid pump for such cases, it becomes possible to supply the lubricating oil of the high viscosity to the sliding portions and to prevent the liquid phase working fluid from flowing from the working chamber into the sliding portions.

However, the above fluid machine has a complicated structure, and therefore, it is a problem in increase of the number of parts and increase of assembling steps, when the small diameter shaft portions are formed at the eccentric shaft portion and annular grooves are formed at the large diameter shaft portion to provide therein the seal members.

Furthermore, another Rankine apparatus is known, for example, as disclosed in Japanese Patent Publication No. S59-138707. The Rankine apparatus includes a refrigerant pump, a steam generating device, an expansion device, and a condensing device, which are connected in a circuit. A bypass passage, which communicates an inlet side and an outlet side with each other, is provided at an outside of the refrigerant pump. A bypass passage closing device is provided in the bypass passage. A check valve is provided at the inlet side of the steam generating device, an expansion-side closing device is provided at the inlet side of the expansion device, and pressure detecting devices are provided at the inlet and outlet side of the expansion device.

In the Rankine apparatus, the expansion-side closing device is opened at starting up the Rankine apparatus. The bypass passage closing device is closed when a detected pressure difference obtained by the pressure detecting devices becomes higher than a predetermined value. The bypass passage closing device is opened when stopping the Rankine apparatus. The expansion-side closing device is closed when the detected pressure difference obtained by the pressure detecting devices becomes smaller than the predetermined value.

According to the above structure and operation, the pressure at a high pressure side and the pressure at a low pressure side are equalized by opening the bypass passage closing device provided in the bypass passage. A ratio of change of the differential pressure between the high pressure side and the low pressure side, for a unit time, is made smaller. As a result, a safer starting up and stopping operation is realized.

At the starting up operation of the Rankine apparatus, the working fluid in the steam generating device is in the liquid phase condition, because the working fluid is not yet sufficiently heated. Therefore, the liquid phase working fluid flows from the steam generating device into the expansion device. In the fluid machine like the above expansion device, lubricating oil is contained in the working fluid, so that lubrication is achieved at sliding portions in the expansion device by circulating the lubricating oil together with the working fluid. In the case that the working fluid is in the liquid phase condition, the viscosity of the lubricating oil is extremely decreased. As a result, sufficient lubrication at the sliding portions may not be achieved.

It is considered as effective to provide the bypass passage at the side of the expansion device, in order to equalize the pressure for the purpose of a safer operation of the Rankine apparatus and at the same time to solve the above problem. However, when the bypass passage is provided as in the apparatus of the above mentioned Japanese Patent Publication, a performance for mounting the apparatus in a limited space is deteriorated and cost for the bypass passage is increased, because the bypass passage is provided at the outside of the expansion device.

SUMMARY OF THE INVENTION

The present invention is made in view of the above problems. And it is, therefore, an object of the present invention to provide a fluid machine of a simplified structure, according to which lubricating oil is supplied to sliding portions of an expansion device, even when a smaller amount of working fluid is included in the lubricating oil.

It is another object of the present invention to provide a fluid machine, according to which lubricating oil is pooled in a housing, the viscosity of the lubricating oil in increased, and the lubricating oil is surely supplied to sliding portions.

It is a further object of the present invention to provide a fluid machine, which is simple in structure for pressurizing sucked working fluid and pumping out, and for surely lubricating sliding portions.

It is still a further object of the present invention to provide an expansion device and a control device thereof, according to which working fluid bypassed by a bypass device according to necessity, and which is advantageous in its mounting performance and cost.

According to a feature of the present invention, a fluid machine has: an expansion device for generating a driving force by expansion of working fluid, which includes lubricating oil and is heated to become gas-phase condition; an electric power generator driven by the driving force of the expansion device and for generating electric power; an oil pooling portion provided in a passage, through which the working fluid discharged from the expansion device flows, for pooling the lubricating oil contained in the working fluid such that the lubricating oil is in contact with at least one of sliding portions of the expansion device and the electric power generator; and a heating unit for heating the working fluid in the oil pooling portion.

Accordingly, the independent oil separating device, which is explained in connection with the above prior art, is not necessary. The lubricating oil of the high viscosity is supplied to the sliding portions, because the working fluid in the oil pooling portion is heated by the heating unit and thereby the working fluid is vaporized from the lubricating oil.

According to another feature of the present invention, a fluid machine has: an expansion device for generating a driving force by expansion of working fluid, which includes lubricating oil and is heated to become gas-phase condition; an electric power generator operated with the expansion device; and a housing for accommodating the expansion device and the electric power generator. The fluid machine further comprises: an oil separating portion for separating the lubricating oil contained in the working fluid discharged from the expansion device; an oil pooling portion provided in the housing for pooling the lubricating oil separated from the working fluid; a heating unit for heating the lubricating oil; and an oil supply portion for supplying the lubricating oil pooled in the oil pooling portion to sliding portions of the expansion device.

Accordingly, the lubricating oil separated from the working fluid can be surely pooled in the oil pooling portion of the housing. Then, the lubricating oil can be heated to vaporize the working fluid contained in the lubricating oil. Therefore, the lubricating oil of the high viscosity is supplied to the sliding portions of the expansion device by the oil supply portion.

According to a further feature of the present invention, a fluid machine has a flat and annular cylinder for forming a cylinder chamber; a ring shaped piston accommodated in the cylinder chamber; a driving shaft inserted into a center portion of the ring shaped piston and driven by an external driving source; and bearings for rotatably supporting the driving shaft. In such fluid machine, the ring shaped piston is operated within the cylinder chamber by rotation of the driving shaft, so that working fluid sucked into the cylinder chamber is pressurized and pumped out, an oil storing chamber is so formed around the driving shaft as to cover contacting portions of the driving shaft, which are in contact with the ring shaped piston and the bearings, the oil storing chamber being filled with lubricating oil having a higher viscosity than the working fluid, and a small space is formed at an axial side surface of the ring shaped piston and at an outer side of the oil storing chamber, the small space being held at a pressure lower than that of the oil storing chamber.

As above, the oil storing chamber is so formed as to cover the contacting portions of the driving shaft, which are in contact with the ring shaped piston and the bearings. The smooth lubrication at the sliding portions is assured by filling the oil storing chamber with the lubricating oil of the high viscosity. In addition, the small spaces are formed at the axial side surfaces of the ring shaped piston and at the outer side of the oil storing chamber, wherein the pressure in the small spaces is held at such a pressure lower than the pressure in the oil storing chamber. As a result, the working fluid of the low viscosity, which flows from the pump chamber formed in the cylinder chamber to the axial side surfaces of the ring shaped piston, is collected in the small spaces, so that the working fluid is prevented from flowing into the oil storing chamber. Finally, it is avoided that the lubricated oil in the oil storing chamber is diluted and the diluted lubricating oil blocks the formation of the oil film at the sliding portions.

It is possible to structure the small spaces, the pressure of which is held at the pressure lower than that in the oil storing chamber, without increasing the number of parts and assembling steps. Accordingly, the lubrication at the sliding portions can be surely carried out by a simple structure, in which the oil storing chamber and the small spaces are formed.

According to a still further feature of the present invention, an expansion device has: a high pressure chamber, into which working fluid heated to a high pressure steam is introduced; a driven portion driven by expansion of the working fluid of the high pressure steam from the high pressure chamber; a low pressure portion, from which the working fluid, a pressure of which becomes lower as a result of the expansion, flows out of the expansion device; and a housing for accommodating the above high pressure chamber, the driven portion, and the low pressure portion. The expansion device further comprises: a communication port formed in the housing for bypassing the driven portion and for directly communicating the high pressure chamber with the low pressure portion; and a switching device for opening and closing the communication port.

As above, the expansion device is realized, in which it is possible for the working fluid to bypass the driven portion by opening the switching device according to need. Namely, it is possible in the expansion device to easily equalize the pressure between the high pressure chamber and the low pressure portion, so that it becomes possible to safely and surely stop the expansion device. The communication port and the switching device are provided within the space of the housing. Therefore, the external pipe arrangement, as is necessary in the prior art, is not necessary, and in addition the expansion device of the invention is advantageous in its mounting performance and cost.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
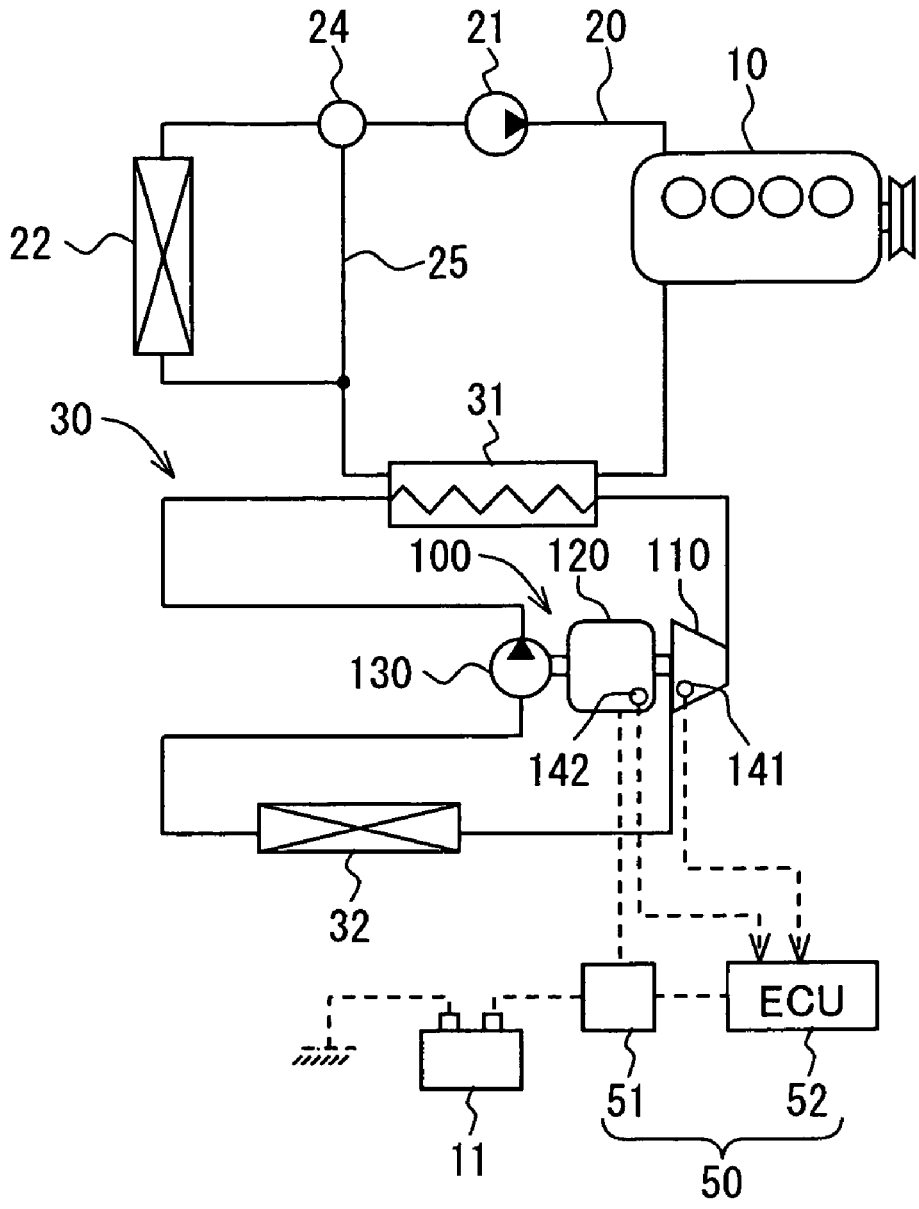
FIG. 1 is a schematic view showing a system structure according to a first embodiment.

In a first embodiment, a fluid machine is formed as such a device 100 integrally having a refrigerant pump, an expansion device and an electric power generator (hereinafter also referred to a pump-expansion-generator device). The pump-expansion-generator device 100 is applied to Rankine cycle 30 for a vehicle. The pump-expansion-generator device 100 comprises the expansion device (i.e. an expansion portion of the present invention) 110, a motor generator (i.e. the electric power generator of the present invention) 120 as an electric motor and as the electric power generator, and the refrigerant pump 130, wherein those components are integrally formed. A system structure will be explained hereinafter with reference FIG. 1.

The Rankine cycle collects energy (as a driving force generated at the expansion device 110) from waste heat generated at an engine 10 (i.e. an external heat energy source of the present invention). The Rankine cycle is formed by the refrigerant pump 130, a heating device 31, the expansion device 110, and a condensing device 32, which are sequentially connected.

The refrigerant pump 130 pumps out refrigerant (i.e. working fluid of the present invention) of the Rankine cycle to the heating device 31, so as to circulate the refrigerant in the Rankine cycle. The details thereof will be explained below as a part of the pump-expansion-generator device 100.

The heating device 31 is a heat exchanger for heating the refrigerant (converting the refrigerant to super-heated steam) by heat-exchange between the refrigerant supplied by the refrigerant pump 130 and engine cooling water (hot water) of a hot water circuit 20 provided for the engine 10.

A water pump 21 of an electrically operated type is provided in the hot water circuit 20 for circulating the engine cooling water. A radiator 22 is also provided in the hot water circuit 20 for cooling down the engine cooling water by the heat-exchange with the external air. A radiator bypass passage 25 is provided to the radiator 22, so that an amount of the engine cooling water flowing through the radiator 22 is adjusted by a thermostat 24, a valve portion of which is opened or closed depending on the temperature of the engine cooling water.

The expansion device 110 generates the driving force by expansion of the super-heated steam of the refrigerant (i.e. the gas-phase working fluid of the present invention) supplied from the heating device 31. The details thereof will be explained below as a part of the pump-expansion-generator device 100. The condensing device 32 is a heat exchanger for cooling down low pressure refrigerant expanded and discharged from the expansion device 110 to condense (liquidize) the refrigerant.

A control unit 50 is provided for controlling an operation of the motor generator 120 of the pump-expansion-generator device 100. The control unit 50 has an inverter 51 and a controller 52.

The inverter 51 controls the electric power supply from a battery 11 of the vehicle to the motor generator 120, when the motor generator 120 is operated as the electric motor. On the other hand, the inverter 51 charges the generated electric power into the battery 11, when the motor generator 120 is operated as the electric power generator by the driving force of the expansion device 110. The controller 52 controls the operation of the inverter 51.

Figure 2:
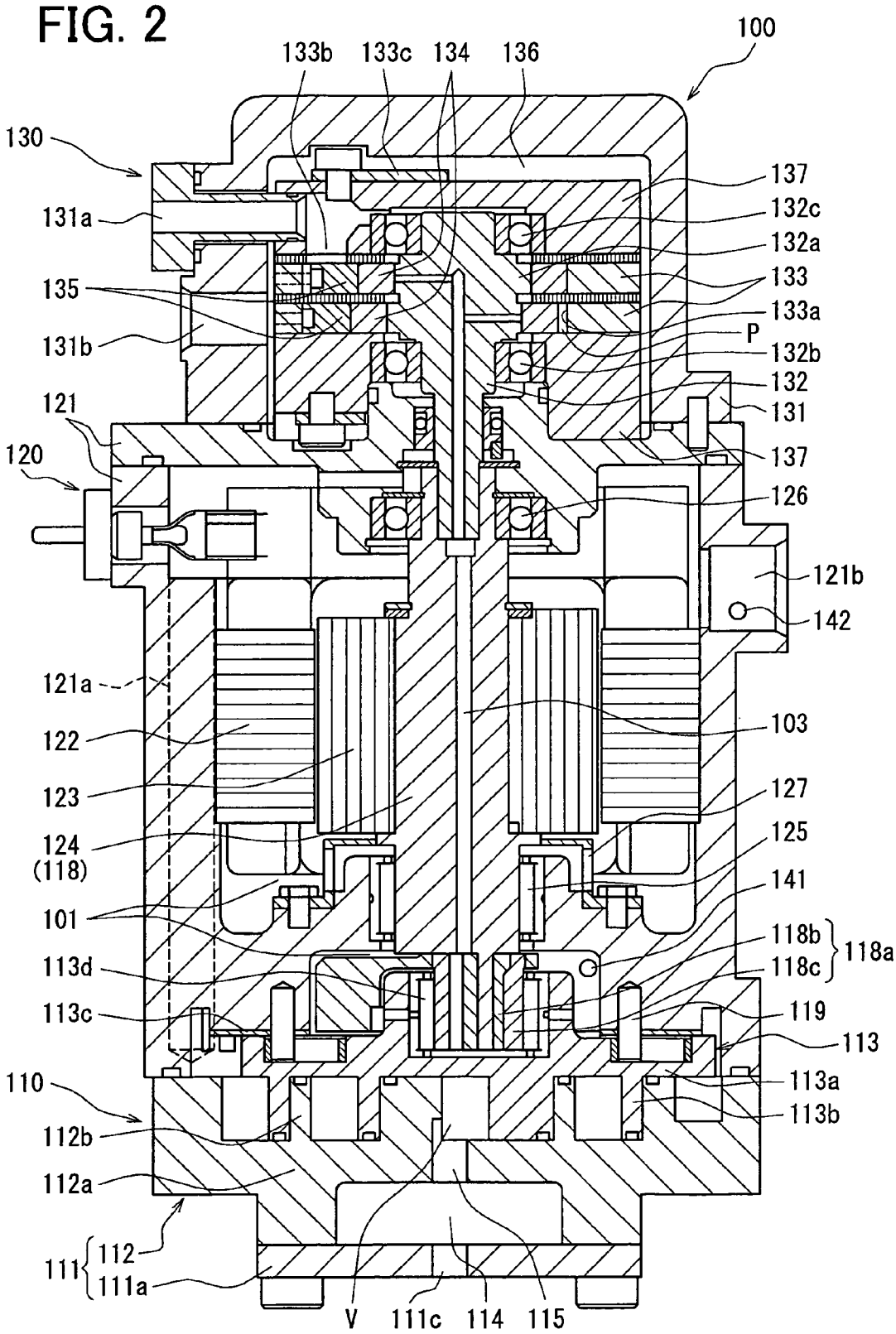
FIG. 2 is a cross sectional view showing a fluid machine (an integrated machine of a refrigerant pump, an expansion device and an electric power generating device) according to the first embodiment of the present invention.

A structure of the pump-expansion-generator device 100 will be explained with reference to FIG. 2. In the pump-expansion-generator device 100, the expansion device 110, the motor generator 120, and the refrigerant pump 130 are coaxially arranged and integrally formed. An operating shaft of the pump-expansion-generator device 100 is vertically arranged, so that the expansion device 110, the motor generator 120, and the refrigerant pump 130 are arranged in this order from a lower end thereof.

The expansion device 110 has the same structure to a well-known scroll type compressor. The expansion device 110 comprises a front housing 111*a* and a fixed scroll 112, wherein the front housing 111*a* and the fixed scroll 112 form a housing 11 for the expansion device. The expansion device 110 further has a movable scroll 113 facing to and rotated with respect to the fixed scroll 112, and an inlet port 115 communicated with a working chamber V through a high pressure chamber 114.

The fixed scroll 112 has a base plate 112*a* and a vortical scroll wrap 112*b* extending from the base plate 112*a* toward the movable scroll 113, whereas the movable scroll 113 has a vortical scroll wrap 113*b* to be contacted and engaged with the vortical scroll wrap 112*b* and a base plate 113*a* on which the scroll wrap 113*b* is formed. The working chamber V is formed between the fixed scroll 112 and the movable scroll 113, the scroll wraps 112*b* and 113*b* of which are operatively contacted with each other. The volume of the working chamber V is expanded or contracted when the movable scroll 113 is rotated with respect to the fixed scroll 112.

The high pressure chamber 114 is a space formed between the front housing 111*a* and the fixed scroll 112. A high pressure port 111*c* is formed at the front housing 111*a*, so that an inside space of the high pressure chamber 114 is communicated with the outside thereof. The high pressure port 111*c* is connected to the heating device 31.

The inlet port 115 is formed at a center portion of the base plate 112*a*, so that the high pressure chamber 114 is communicated with the working chamber V, which has become to its minimum volume. The high-temperature and high-pressure refrigerant, namely the super-heated steam of the refrigerant, supplied to the high pressure chamber 114 is introduced into the working chamber V.

A shaft 118 of the expansion device 110 is connected to (i.e. integrally formed with) a motor shaft 124 of the motor generator 120, which will be explained below. A crank portion 118*a* is provided at one end of the shaft 118 (a lower end thereof in FIG. 2), wherein the crank portion 118*a* is eccentric with respect to a rotational center of the shaft 118. The crank portion 118*a* is connected to the movable scroll 113 via a bearing 113*d* (i.e. a sliding portion of the present invention). In the crank portion 118*a*, a bushing 118*c* is rotatably provided onto an eccentric shaft 118*b*.

A sliding plate 113*c* (i.e. the sliding portion of the present invention) is provided between the movable scroll 113 and a motor housing 121 explained below, to assist a smooth orbital movement of the movable scroll 113.

A self rotation prevention mechanism 119 is provided at the movable scroll 113, so that the movable scroll 113 does not rotate around its own axis but around the shaft 118 (i.e. the motor shaft 124) with the orbital motion. The volume of the working chamber V becomes larger, as the working chamber is moved from its center toward the outside portion of the movable scroll 113 in accordance with the expansion of the super-heated steam of the refrigerant from the heating device 31 or the rotation of the motor shaft 124 (i.e. the driving force from the motor generator 120).

The motor generator 120 is an electric rotating device of an alternating current type, which comprises a stator 122 and a rotor 123 rotating in the inside of the stator 122, and is accommodated in the motor housing 121. The motor housing 121 is formed into a cylindrical shape and has a bottom plate and an upper plate at its both ends of a longitudinal direction.

The stator 122 is a stator coil wound with electric wires and is fixed to an inner peripheral surface of the motor housing 121. The stator 122 corresponds to a heating unit and/or an armature of the present invention. The rotor 123 is a magnet rotor, in which permanent magnets are provided, and is fixed to the motor shaft 124. The motor shaft 124 is rotatably supported by bearings 125, 126 (corresponding to the sliding portion of the present invention), respectively fixed to the bottom plate and the upper plate of the motor housing 121. One end of the motor shaft 124 on a side of the expansion device 110 (i.e. the lower side in FIG. 2) is connected to the shaft 118 and the crank portion 118*a* of the expansion device 110. The other end of the motor shaft 124 on a side of the refrigerant pump 130 (i.e. an upper side in FIG. 2) is so formed that its diameter is smaller, and is connected to a pump shaft 132 explained below.

A portion adjacent to the bearing 125 fro the bottom plate of the motor housing 121 is opened to a side of the movable scroll 113, such that the inside of the motor housing 121 is communicated with an upper side of the movable scroll 113, namely with the bearing 113*d* and the sliding plate 113*c*. A filter 127 is provided at a surrounding area (i.e. an upper and outer peripheral side) of the bearing 125, in order to prevent extraneous materials mixed into the refrigerant and the lubricating oil from adhering to the bearing 125.

A discharged gas passage 121*a* is provided at a side portion of the motor housing 121 (at a left-hand side in FIG. 2), to communicate the low pressure side (the outer peripheral side of the scrolls) of the scrolls 112, 113 of the expansion device 110 with an upper portion in the motor housing 121. A low pressure port 121*b* is provided at the upper portion of the motor housing 121, which is an opposite side (at a right-hand side in FIG. 2) to the discharged gas passage 121*a*, in order that the inside of the motor housing 121 is communicated to the outside thereof. The low pressure port 121*b* is connected to the condensing device 32.

Accordingly, in the pump-expansion-generator device 100 of the embodiment, as explained below, the refrigerant discharged from the expansion device 110 flows into the inside of the motor housing 121 through the discharged gas passage 121*a*, and flows out from the low pressure port 121*b*. An inside space of the motor housing 121 below the low pressure port 121*b* as well as the space formed between the bottom plate of the motor housing 121 and the movable scroll 113 and communicated with the inside space via the lower side of the bearing 125 is formed as an oil pooling portion 101.

A temperature sensor 141 is provided in the space formed between the bottom plate of the motor housing 121 and the movable scroll 113. A temperature signal detected by the temperature sensor 141 is inputted to the controller 52 (FIG. 1). A pressure sensor 142 is provided at the low pressure port 121*b* for detecting the pressure of the refrigerant. A pressure signal detected by the pressure sensor 142 is inputted to the controller 52 (FIG. 1).

The motor generator 120 is operated as the motor (the electric motor) to rotate the rotor 123 so as to drive the expansion device 110 and the refrigerant pump 130 (described below), when the electric power is supplied to the stator 122 from the battery 11 via the inverter 51 at starting up the Rankine cycle 30. On the other hand, when a torque for rotating the rotor 123 is inputted by the driving force produced by the expansion at the expansion device 110, the refrigerant pump 130 is driven. And when the driving force produced at the expansion device 110 exceeds the driving force for the refrigerant pump 130, the motor generator 120 is operated as the generator (the electric power generator) for generating the electric power. The electric power thus obtained is charged into the battery 11 via the inverter 51.

The refrigerant pump 130 is a two-stage pump of a rolling piston type. The refrigerant pump 130 is arranged at a side of the motor generator 120 opposite to the expansion device 110, and is accommodated in a pump housing 131 fixed to the motor housing 121.

The refrigerant pump 130 has the pump shaft 132, cylinders 133*a*, rotors 134, and so on formed in the inside of the pump housing 131. The cylinders 133*a* are formed into a cylindrical shape at a central portion of a cylinder block 133.

The pump shaft 132 is connected to the motor shaft 124 by means of a spline, and rotatably supported by bearings 132*b* and 132*c* fixed to end plates 137, between which the cylinder blocks 133 are interposed. A circular cam portion 132*a* is formed at the pump shaft 132, such that the cam portion 132*a* is eccentric to the pump shaft 132. Cylindrical flat rotors 134 are provided at outer peripheries of the cam portion 132*a*. An outer diameter of the rotors 134 is made smaller than an inner diameter of the cylinder 133*a*. The rotors 134 are arranged inside the cylinder 133*a*, so that the rotors 134 are rotated within the cylinder 133*a* with the orbital motion by the cam portion 132*a*. Vanes 135 are provided at outer peripheries of the rotors 134, such that the vanes 135 are slidable with respect to the rotors 134 in a radial direction and biased toward a center of the rotors 134. Spaces surrounded by the rotors 134 and the vanes are formed as pump chambers P in the cylinder 133*a*.

A refrigerant inlet portion 133*b* and a refrigerant outlet portion (not shown) are provided in the cylinder block 133 at such portions close to the vanes 135, in order to be communicated with the inside of the cylinder 133*a*. The refrigerant inlet portion 133*b* is communicated with a suction port 131*a* penetrating the pump housing 131, whereas the refrigerant outlet portion is communicated with a high pressure chamber 136, which is formed between the pump housing 131 and the cylinder block 133 (i.e. the end plates 137), through a discharge valve 133*c*. The high pressure chamber 136 is communicated with a discharge port 131*b* formed at a side wall of the pump housing 131 on a side to the motor generator 120.

In the refrigerant pump 130, the refrigerant sucked, by the orbital motion of the rotors 134, into the pump chambers P through the suction port 131*a* and the refrigerant inlet portion 133*b*, and discharged from the discharge port 131*b* through the refrigerant outlet portion, the discharge valve 133*c*, and the high pressure chamber 136.

A shaft passage 103 is formed in the inside of the shaft 118, the motor shaft 124, and the pump shaft 132, which are integrally formed with one another, such that a longitudinal end portion of the bushing 118*c* is communicated with the outer peripheral portion of the cam portion 132*a*. An inner diameter of a part of the shaft passage 103, which is closer to the outer peripheral portion of the cam portion 132*a*, is made smaller so that the part of the shaft passage has a certain flow resistance.

An operation of the pump-expansion-generator device 100 according to the embodiment will be explained with reference to FIGS. 3 to 6.

Figure 3:
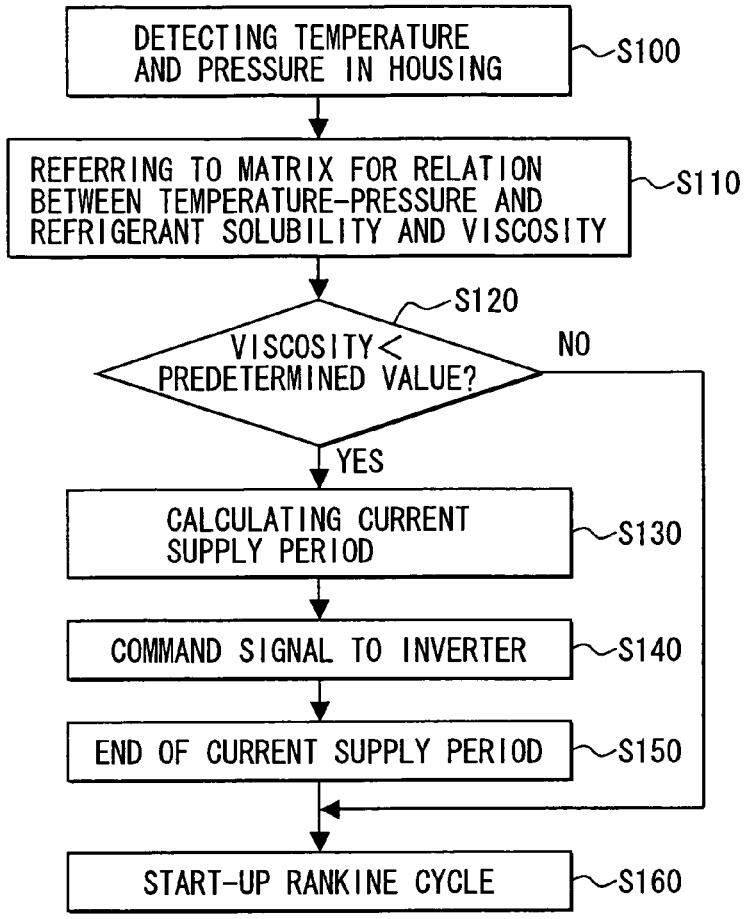
FIG. 3 is a flowchart for increasing viscosity of lubricating oil before starting the system of the first embodiment of the present invention.

1. Before Starting Up Rankine Cycle:

In the case that sufficient amount of waste heat can be obtained from the engine 10 (namely, when the temperature of the engine cooling water is sufficiently high), the controller 52 heats the refrigerant in the oil pooling portions 101 in the motor housing 121 and above the movable scroll 113, by making use of the stator 122 of the motor generator 120 as the heating unit in accordance with the control flow shown in FIG. 3, before starting up the Rankine cycle 30.

Namely, the controller 52 detects the temperature and the pressure of the refrigerant in the motor housing 121 from the temperature sensor 141 and the pressure sensor 142, at a step S100 shown in FIG. 3.

Then, at a step S110, the viscosity of the lubricating oil is calculated from the detected temperature and pressure of the refrigerant. Namely, a solubility characteristic for the refrigerant with respect to the temperature-pressure shown in FIG. 4 (hereinafter the refrigerant solubility characteristic) as well as a viscosity characteristic for the lubricating oil with respect to the temperature shown in FIG. 5 (hereinafter the lubricant viscosity characteristic) is memorized in the controller in advance, so that the viscosity of the lubricating oil is calculated from both of the characteristics.

Figure 4:
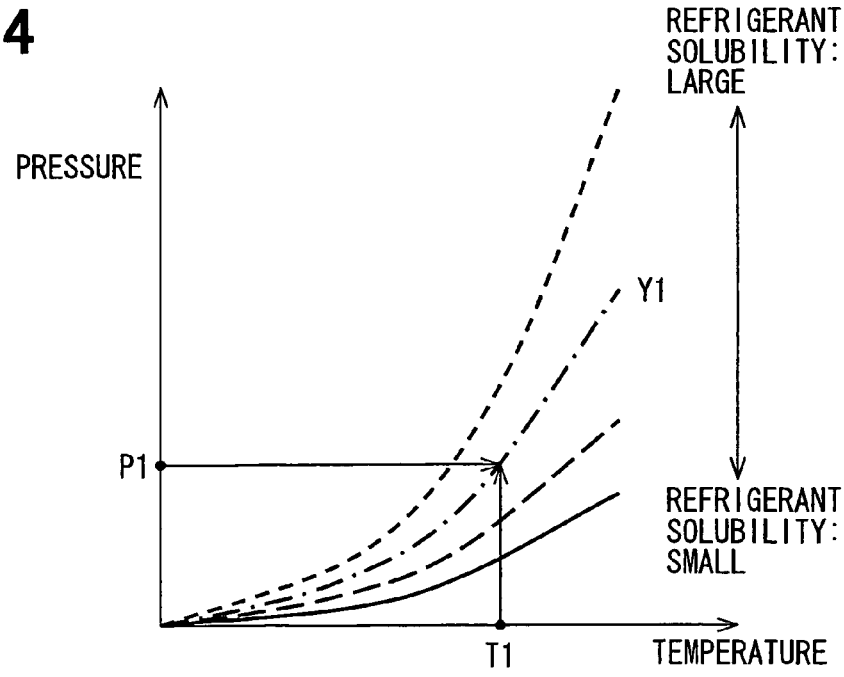
FIG. 4 is a characteristic graph showing solubility curves with respect to temperature and pressure.

More in detail explained, the refrigerant solubility characteristic shows a relation between the temperature and the pressure, wherein the solubility of the refrigerant is selected as a parameter. For example, the solubility of the refrigerant is lower as the temperature is higher, in the case that the pressure is constant, whereas the solubility of the refrigerant is higher as the pressure is higher, in the case that the temperature is constant. The solubility "Y1" of the refrigerant is decided when the temperature "T1" and the pressure "P1" are detected, as shown in FIG. 4.

Figure 5:
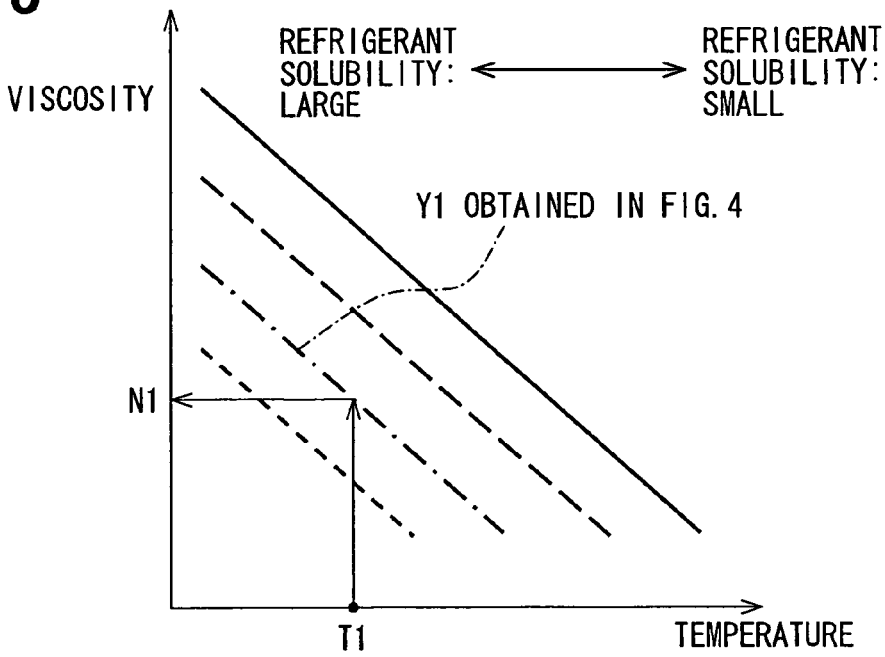
FIG. 5 is a characteristic graph showing viscosity of lubricating oil with respect to temperature.

Furthermore, the lubricant viscosity characteristic shows a relation between the temperature and the viscosity of the lubricating oil, wherein the solubility of the refrigerant is selected as a parameter. For example, the viscosity of the lubricating oil is lower as the temperature is higher, in the case that the solubility of the refrigerant is constant, whereas the viscosity of the lubricating oil is higher as the solubility of the refrigerant is smaller. The viscosity "N1" is decided when the temperature "T1" is detected and the solubility "Y1" of the refrigerant is calculated from the refrigerant solubility characteristic, as shown in FIG. 5.

At a step S120, the controller determines whether or not the above obtained viscosity "N1" is lower than a predetermined viscosity (which corresponds to a predetermined value of the present invention). When it is determined as "YES", the controller supplies a predetermined direct current to the stator 122 of the generator 120 at a predetermined voltage, and calculates a current supply period for operating the stator 122 as the heating unit, at a step S130. Namely, the controller calculates how much amount of the current refrigerant is heated to vaporize (with how much heat quantity), based on the refrigerant solubility calculated at the step S110, so that the viscosity of the lubricating oil becomes higher than the predetermined viscosity. The controller further calculates a time period necessary for achieving the heat quantity (the predetermined voltage X the predetermined current X the time period) as the above current supply period.

At a step S140, the controller 52 outputs a command signal to the inverter 51, so that the electric current of the predetermined voltage and predetermined current is supplied from the inverter 51 to the stator 122 during the above current supply period. In this operation, the current supply is carried out with a command that rotation is zero, so that the rotor 123 is not rotated by the current supply to the stator 122. Accordingly, heat is generated at the stator 122 such that the refrigerant in the motor housing 121 and in the space above the movable scroll 113, i.e. the refrigerant pooled in the oil pooling portions 101, is heated. As a result that the refrigerant is heated, the solubility of the refrigerant is decreased and the viscosity of the lubricated oil contained in the refrigerant is increased. Therefore, the lubricating oil having the high viscosity is supplied to the sliding portions of the expansion device 110 and the motor generator 120, i.e. to the bearing 113*d*, the sliding plates 113*c*, and the bearings 125 and 126.

When the current supply period passes by at a step S150, the controller stops the current supply and the process goes to a step S160, at which a start-up operation for a normal operation of the Rankine cycle 30 is carried out. In the case that, at the step S120, the viscosity of the lubricating oil is higher than the predetermined viscosity, the process goes to the step S160 without carrying out the steps S130 to S150.

2. Starting Up Rankine Cycle:

When starting up the Rankine cycle 30, the controller 52 operates the motor generator 120 as the electric motor by supplying the electric power from the inverter 51, so as to drive the expansion device 110 and the refrigerant pump 130. Then, the refrigerant is supplied from the refrigerant pump 130 to the heating device 31, and the supplied refrigerant is heated by the heating device 31.

The super heated steam of the refrigerant, which is heated by the heating device 31 to the high temperature and high pressure, is introduced into the working chamber V of the expansion device 110 and expanded therein. When the movable scroll 113 is rotated by the expansion of the super heated steam of the refrigerant, the motor generator 120 and the refrigerant pump which are connected to the movable scroll 113 are driven. When the driving force of the expansion device 110 exceeds a driving power for driving the refrigerant pump 130, the motor generator 120 is operated as the electric power generator, so that the controller 52 charges the electric power generated by the motor generator 120 into the battery 11 through the inverter 51.

The low pressure refrigerant, the pressure of which is decreased after having ended with the expansion at the expansion device 110, is circulated through the condensing device 32, the refrigerant pump 130, the heating device 31, and the expansion device 110 (the circulation in the Rankine cycle 30).

Figure 6:
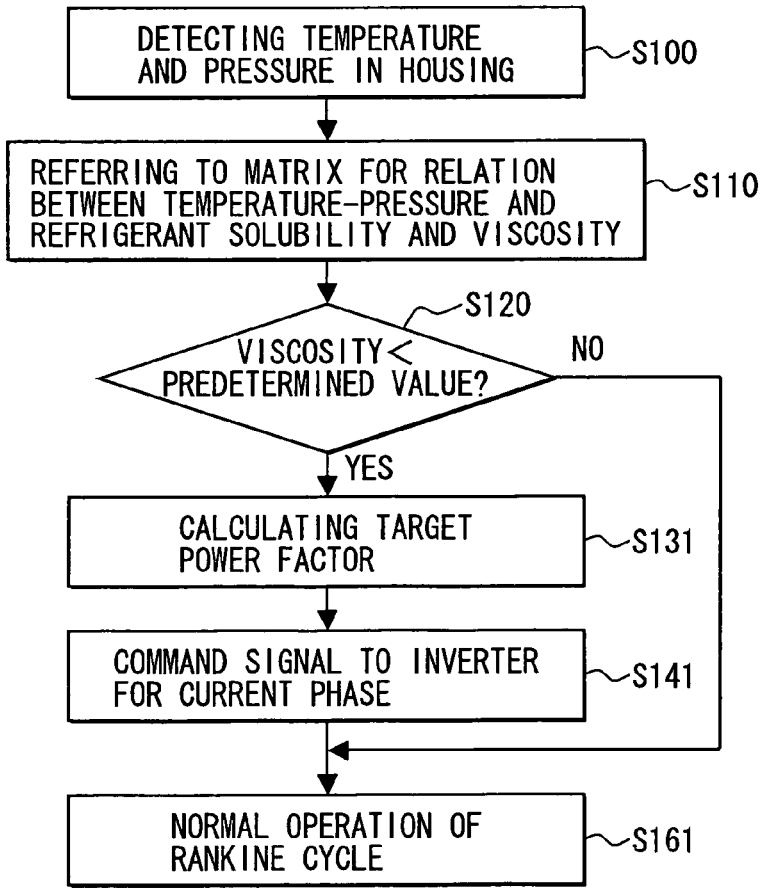
FIG. 6 is a flowchart for increasing viscosity of lubricating oil during a normal operation of the system of the first embodiment of the present invention.

3. Normal Operation:

The controller 52 controls to heat the refrigerant in the motor housing 121 and in the oil pooling portion 101 above the movable scroll 113, in accordance with a control flow shown in FIG. 6, even during a normal operation after the Rankine cycle 30 has been started up as above. In the control flow of FIG. 6, steps after the step S120 are modified from those explained with reference to FIG. 3.

Namely, the controller 52 carries out the steps S100 to S120 in the same manner to the above steps (FIG. 3), and at a step S131 the controller 52 decrease efficiency of the operation and calculates a power factor for operating the stator 122 as the heating unit, when the controller 52 determines at the step S120 that the viscosity of the lubricating oil is smaller than the predetermined viscosity. Namely, the controller calculates how much amount of the current refrigerant is heated to vaporize (with how much heat quantity), based on the refrigerant solubility calculated at the step S110 during the normal operation, so that the viscosity of the lubricating oil becomes larger than the predetermined viscosity. And further the controller calculates the power factor to achieve the heat quantity. The power factor is equal to a cosine of a phase difference of the electric current with respect to the electric voltage.

The controller 52 outputs to the inverter 51, at a step S141, a command signal for the current phase difference corresponding to the above calculated power factor, and drives the motor generator 120 at a step S161. Then, the stator 122 generates more heat than that in the timing before outputting the command signal for the current phase difference.

The super heated steam of the refrigerant, which is heated by the heating device 31 to the high pressure steam, flows into the high pressure chamber 114 through the high pressure port 111*c* during the normal operation of the Rankine cycle 30. The refrigerant flows through the inlet port 115, the working chamber V, the low pressure sides (the outer peripheral sides) of the scrolls 112, 113, the discharged gas passage 121*a*, the motor housing 121, and the low pressure port 121*b*, and flows to the condensing device 32.

When the super heated steam of the refrigerant flows from the discharged gas passage 121*a* into the motor housing 121, flow speed thereof is decreased due to an enlargement of the flow passage, and the lubricating oil is separated from the refrigerant, reaching the bearing 126. The lubricating oil goes down due to its own weight through windings of the stator 122 and the rotor 123 of the motor generator 120, reaching the bearing 125, the bearing 113*d*, and the sliding plate 113*c*. In this operation, the refrigerant is actively heated by the heat generated at the stator 122 as a result of the decrease of the power factor, so that the solubility of the refrigerant is decreased and the viscosity of the lubricating oil is increased. Accordingly, the lubricating oil of the high viscosity is supplied to the bearings 126, 125, the bearing 113*d*, and the sliding plate 113*c*.

Furthermore, the lubricating oil reaching the bearing 113*d* flows to the bearings 132*b*, 132*c* through the shaft passage 103 and the rotors 134 of the refrigerant pump 130. The lubricating oil reaching the bearings 132*b*, 132*c* is again melt in the liquid-phase refrigerant in the pump chambers P of the refrigerant pump 130, so that the lubricating oil is repeatedly circulated in the Rankine cycle 30.

In the case that, at the step S120, the viscosity of the lubricating oil is higher than the predetermined viscosity, the process goes to the step S161 without carrying out the steps S131 to S141, to continue the normal operation of the Rankine cycle 30.

As explained above, in the pump-expansion-generator device 100 according to the embodiment, the stator 122 is operated as the heating unit depending on the viscosity of the lubricating oil in the refrigerant, to heat the refrigerant so as to increase the viscosity of the lubricating oil. Accordingly, since the lubricating oil having the high viscosity can be supplied to the respective sliding portions 126, 125, 113*c*, and 113*d*, the lubricating property at the respective sliding portions 126, 125, 113*c*, and 113*d* can be increased to thereby improve reliability (durability). In the present embodiment, an independent oil separating device, which is explained in the prior art, is not necessary. The present invention is more advantageous in its mounting performance, in particular when the invention is used for the vehicle as in the above embodiment.

Furthermore, it is possible to improve the lubricating property by use of the original components for the motor generator 120, because the stator 122 is operated as the heating unit.

In addition, according to the present embodiment, the heat is generated at the stator 122 to increase the viscosity of the lubricating oil, before starting up the Rankine cycle 30. The viscosity of the lubricating oil is in an extremely low condition, since the refrigerant is generally pooled in the oil pooling portion 101 before the start-up of the expansion device 110. Therefore, the lubricating property at the respective sliding portions 126, 125, 113*c*, and 113*d* is low at the start-up operation. Accordingly, when the heat is generated at the stator 122 at the start-up operation, the viscosity of the lubricating oil is increased to improve the lubricating property at the respective sliding portions 126, 125, 113*c*, and 113*d* at the start-up operation.

During the normal operation of the Rankine cycle 30, the heat is likewise generated at the stator 122 depending on the viscosity of the lubricating oil, to increase the viscosity of the lubricating oil, so that the lubricating property is surely improved even in the normal operation.

Second Embodiment

Figure 7:
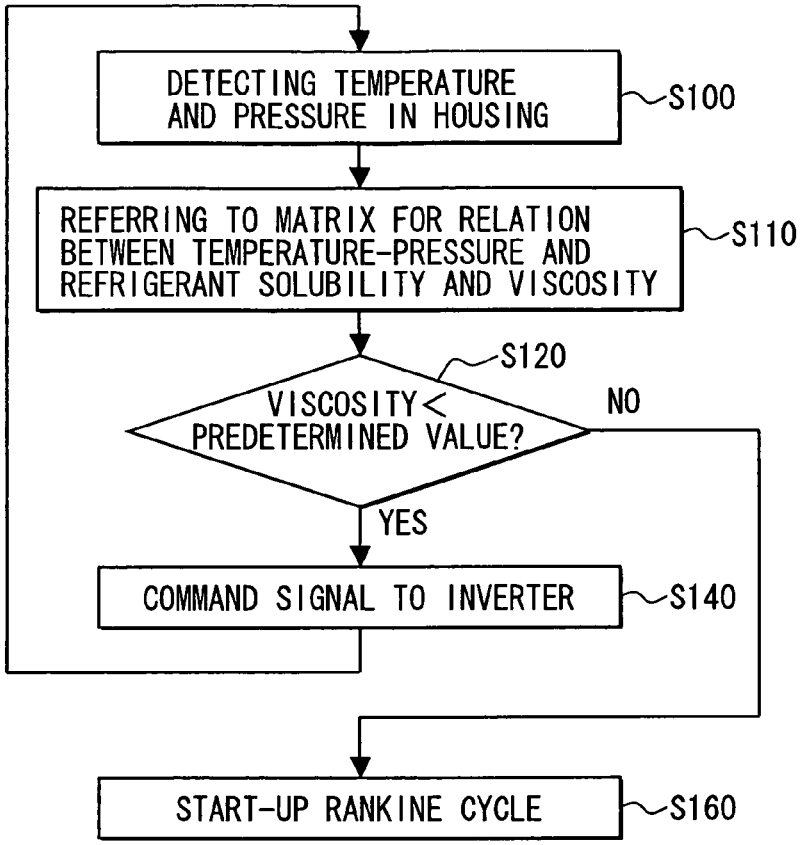
FIG. 7 is a flowchart for increasing viscosity of lubricating oil before starting the system according to a second embodiment of the present invention.

A second embodiment of the present invention is shown in FIG. 7. In the second embodiment, a control (a control flow) before starting up the Rankine cycle 30 is different from that for the first embodiment.

In the control flow of the second embodiment, the steps S130 and S150 of the first embodiment (FIG. 3) are eliminated. Namely, when the controller 52 determines at the step S120 that the viscosity of the lubricating oil is lower than the predetermined viscosity, the controller 52 outputs a command signal at the step S140 for the current supply to the stator 122 so as to heat the refrigerant in the oil pooling portions 101, without calculating the current supply period to the stator 122 of the motor generator 120. The process goes back to the step S100 to detect the temperature and the pressure of the refrigerant by the temperature sensor 141 and the pressure sensor 142. In the case that the viscosity of the lubricating oil becomes higher than the predetermined viscosity at the step S120 by repeating the above steps S100 to S140, the process moves on to a step S160 to start up the Rankine cycle 30.

According to the above second embodiment, it is not necessary to calculate the current supply period to the stator 122. Instead, the temperature and the pressure of the refrigerant are continuously detected to grasp the viscosity of the lubricating oil before starting up the Rankine cycle 30, so that the viscosity of the lubricating oil is made higher than the predetermined viscosity.

Third Embodiment

Figure 8:
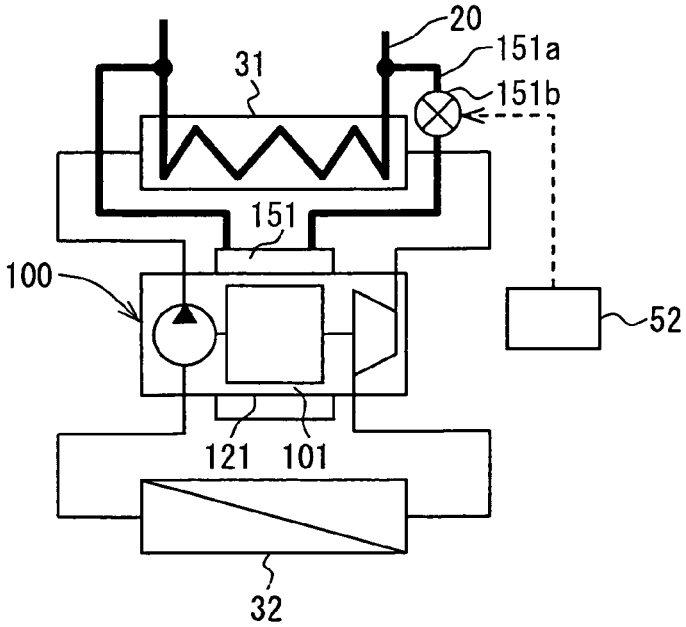
FIG. 8 is a schematic view showing a heating device according to a third embodiment of the present invention.

A third embodiment of the present invention is shown in FIG. 8. In the third embodiment, a heating unit for heating the refrigerant in the oil pooling portions 101 is modified, when compared with the first embodiment.

A water jacket 151 is provided at an outer peripheral portion of the motor housing 121, and a bypass passage 151*a* is connected to the water jacket 151, wherein the bypass passage 151*a* bypasses the heating device 31. The water jacket 151 and the bypass passage 151*a* correspond to a heat medium passage to form the heating unit. An on-off valve 151*b* is provided at the bypass passage 151*a*, wherein the on-off valve is controlled by the controller 52 for opening or closing the passage.

According to the third embodiment, the controller 52 calculates the viscosity of the lubricating oil in the oil pooling portions 101 before the start-up of the Rankine cycle 30 as well as during the normal operation. And the controller 52 opens the on-off valve 151*b* so that the engine cooling water flows from the engine 10 to the water jacket 151, when the viscosity of the lubricating oil is lower than the predetermined viscosity. The engine cooling water corresponds to a heat medium from an outside high temperature heat source of the present invention. Then, the refrigerant in the oil pooling portions 101 is heated by the heat transfer from the engine cooling water (hot water) flowing through the water jacket 151, and thereby the viscosity of the lubricating oil is increased. In other words, the heating unit is formed by effectively making use of the heat medium (the engine cooling water) of the outside high temperature heat source in the Rankine cycle 30.

Fourth Embodiment

Figure 9:
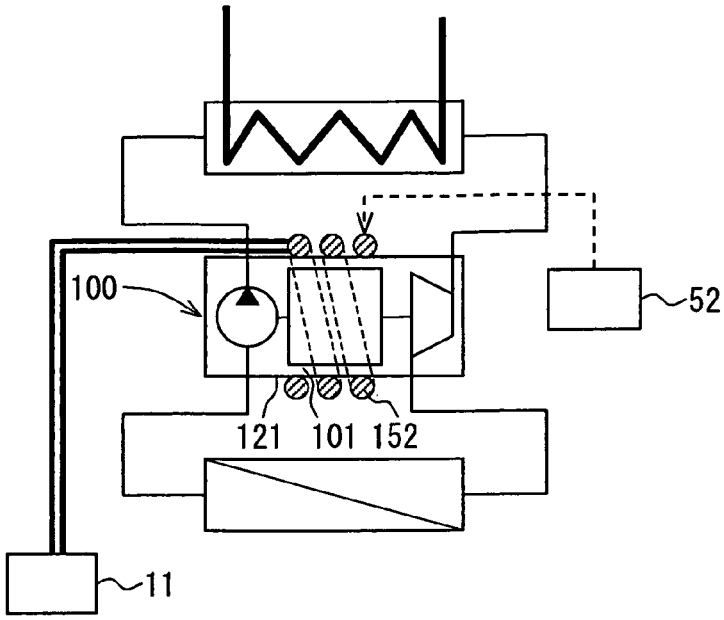
FIG. 9 is a schematic view showing a heating device according to a fourth embodiment of the present invention.

A fourth embodiment of the present invention is shown in FIG. 9. In the fourth embodiment, a heating unit for heating the refrigerant in the oil pooling portions 101 is modified, when compared with the first embodiment.

An electric heating device 152 is provided at the outer peripheral portion of the motor housing 121, and electric current is supplied to the electric heating device 152 by the controller 52 from the battery 11. The electric heating device 152 forms the heating unit.

According to the fourth embodiment, the controller 52 calculates the viscosity of the lubricating oil in the oil pooling portions 101 before the start-up of the Rankine cycle 30 as well as during the normal operation. And the electric current is supplied to the electric heating device 152, when the viscosity of the lubricating oil is lower than the predetermined viscosity. Then, the refrigerant in the oil pooling portions 101 is heated by the heat generated at the electric heating device 152, and thereby the viscosity of the lubricating oil is increased.

(Other Modifications)

According to the above embodiments, the expansion device 110, the motor generator 120, and the refrigerant pump 130 are integrally formed as the pump-expansion-generator device 100, wherein the expansion device 110, the motor generator 120, and the refrigerant pump 130 are arranged from the lower side thereof. However, the structure, arrangement, and the operating position of the fluid machine may be modified in various ways as below.

Figure 10:
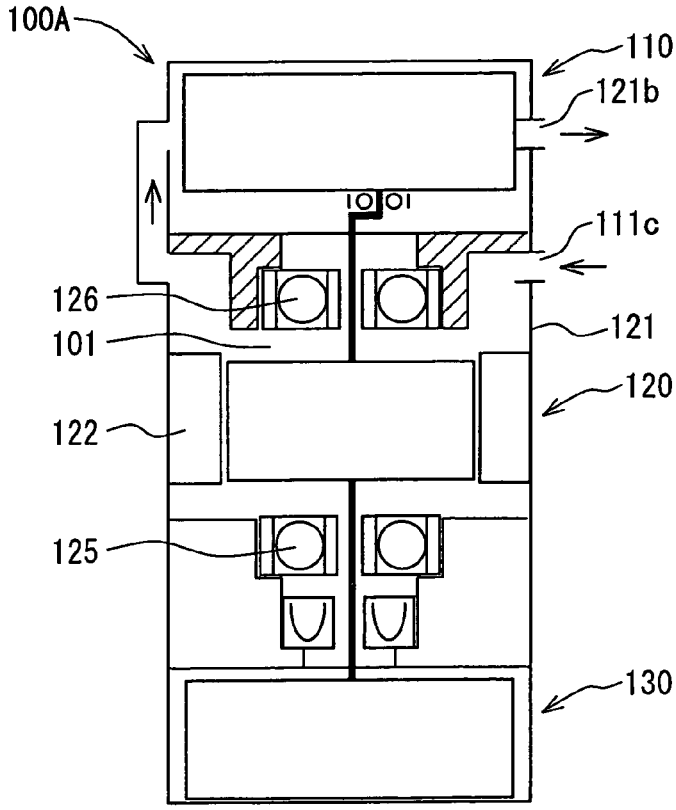
FIG. 10 is a schematic cross sectional view showing a fluid machine according to a first modification of the other embodiments of the present invention.

A first modification is shown in FIG. 10. In a fluid machine 100A of the first modification, the refrigerant pump 130, the motor generator 120 and the expansion device 100 are arranged in this order from the lower end thereof, when compared with the pump-expansion-generator device 100 of the first embodiment. In addition, the high pressure port 111*c*, through which the super heated steam of the refrigerant flows into the motor housing 121 from the heating device 31, is provided at an upper portion of the motor housing 121, whereas the low pressure port 121*b* for discharging expanded low-pressure refrigerant is provided at a side wall portion of the expansion device 110.

According to the first modification, the bearings 125 and 126, which correspond to the sliding portion of the motor generator 120, are arranged in the oil pooling portion 101. The refrigerant in the oil pooling portion 101 is heated by the heating device formed by the stator 122, so that the viscosity of the lubricating oil is increased. The lubricating property for the bearings 125 and 126 is improved by the lubricating oil, the viscosity of which is increased.

Figure 11:
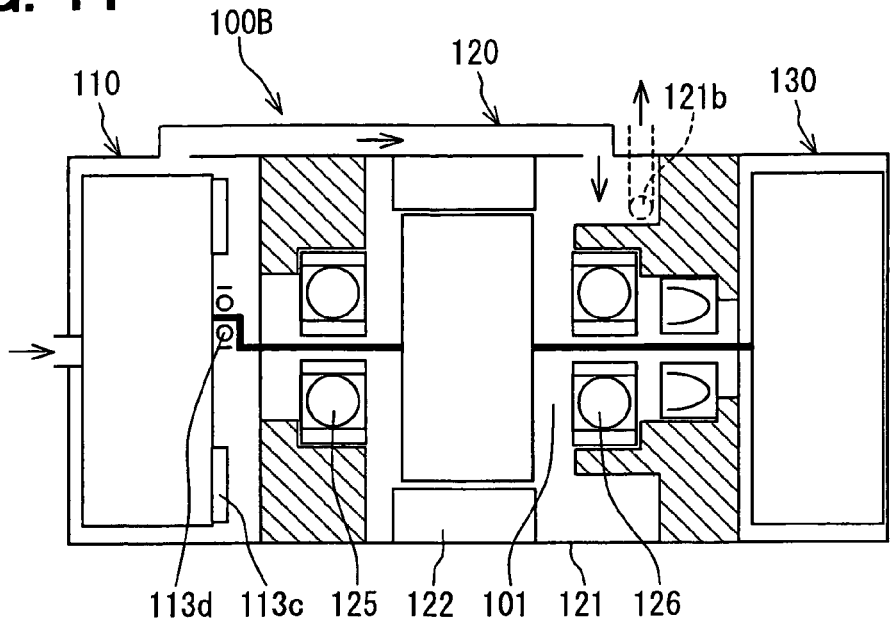
FIG. 11 is a schematic cross sectional view showing a fluid machine according to a second modification of the other embodiments of the present invention.

A second modification is shown in FIG. 11. A fluid machine 100B is arranged such that an operating position thereof is made in a horizontal plane, when compared with the pump-expansion-generator device 100 of the first embodiment. And the low pressure port 121*b* is provided at an upper portion of the motor housing 121, which is on a side to the refrigerant pump 130.

According to the second modification, a space below the low pressure port 121*b* may be formed as the oil pooling portion 101, in which the bearings 113*d*, the sliding plate 113*c* and the bearings 125, 126 are arranged, wherein the bearings 113*d*, the sliding plate 113*c* and the bearings 125, 126 form the sliding portions of the expansion device 110 and the motor generator 120. The refrigerant in the oil pooling portion 101 is heated by the heating device formed by the stator 122, so that the viscosity of the lubricating oil is increased. The lubricating property for the bearing 113*d*, the sliding plate 113*c*, and the bearings 125 and 126 are improved by the lubricating oil, the viscosity of which is increased.

Figure 12:
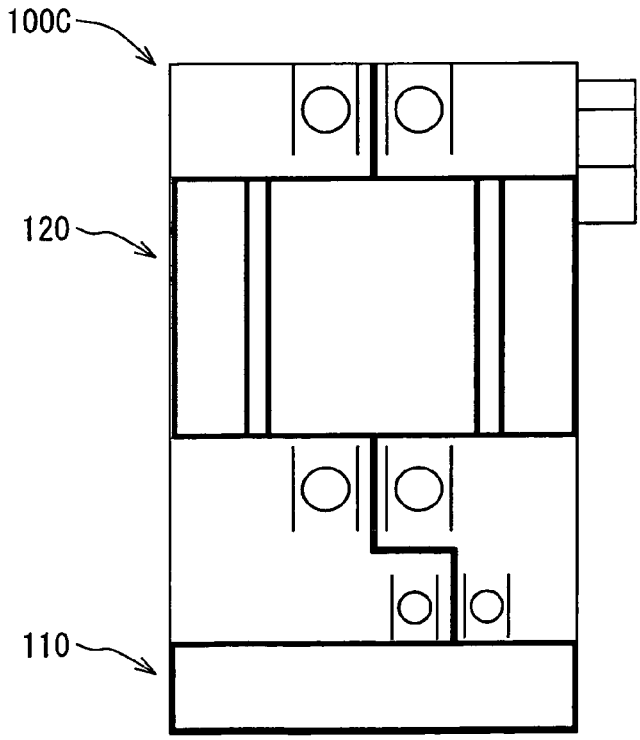
FIG. 12 is a schematic cross sectional view showing a fluid machine according to a third modification of the other embodiments of the present invention.

A third modification is shown in FIG. 12. The fluid machine according to the present invention comprises, as its fundamental components, the expansion device 110 and the motor generator 120. As shown by a fluid machine 100C of the third modification, the refrigerant pump 130 may be eliminated from the pump-expansion-generator device 100 of the first embodiment.

Figure 13:
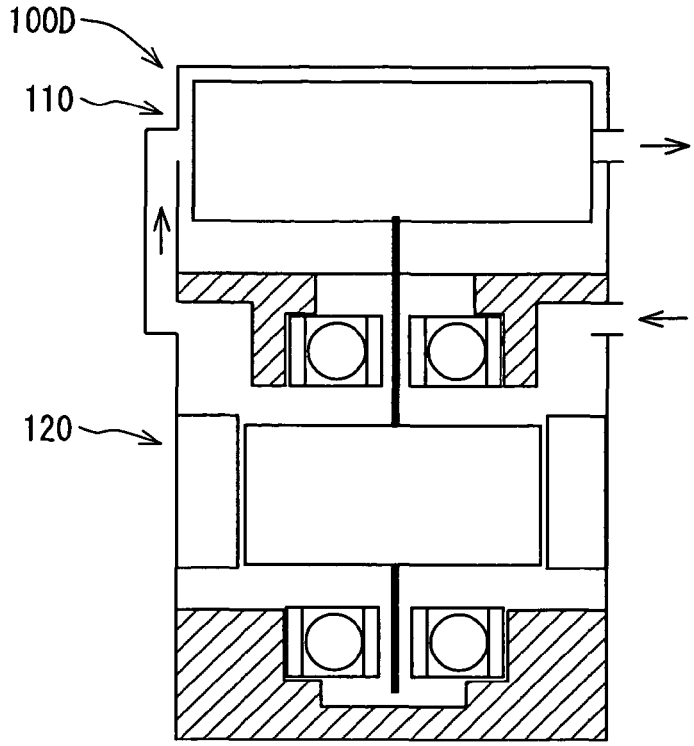
FIG. 13 is a schematic cross sectional view showing a fluid machine according to a fourth modification of the other embodiments of the present invention.
Figure 14:
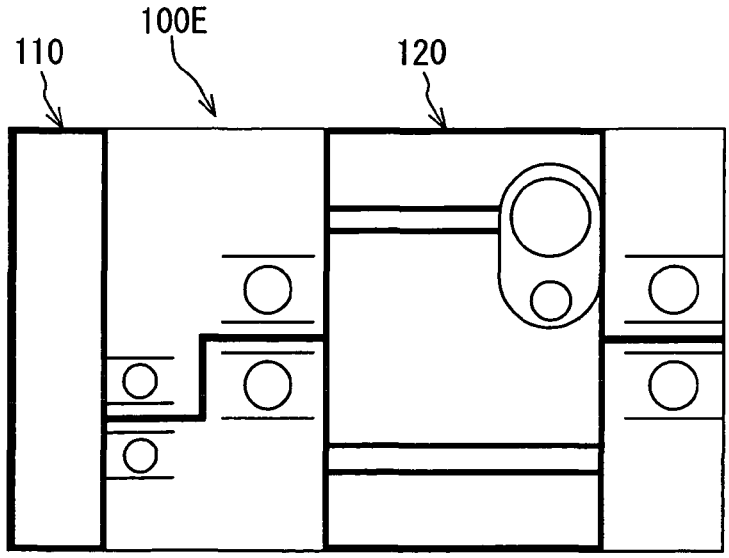
FIG. 14 is a schematic cross sectional view showing a fluid machine according to a fifth modification of the other embodiments of the present invention.

As shown in FIG. 13, the fluid machine may be modified like a fourth modification (a fluid machine 100D) in which vertical positions of the expansion device 110 and the motor generator 120 are exchanged, or as shown in FIG. 14, the fluid machine may be modified like a fifth modification (a fluid machine 100E) in which an operating position is arranged in the horizontal plane, when compared with the third modification.

The inverter 51 may be integrally provided at the outer peripheral portion of the motor housing 121, so as to for the heating unit for heating the refrigerant.

In addition, in the above embodiments, the expansion device 110 is formed by the scroll type device and the refrigerant pump 130 is formed by the rolling piston type device. However, the present invention may not be limited to those types. A gear pump type, a trochoid type, or any other types may be used.

In the above embodiments, the engine 10 for the vehicle (the engine cooling water) is used as the heating source for the heating device 31. Any other devices, which generates heat for its operation and throws away a part of the heat for the purpose of its temperature control (i.e. which generates waste heat), such as an external combustion engine, fuel cell stacks for a fuel cell car, various kinds of motors, and the inverter, can be widely used to the present invention.

Fifth Embodiment

Figure 15:
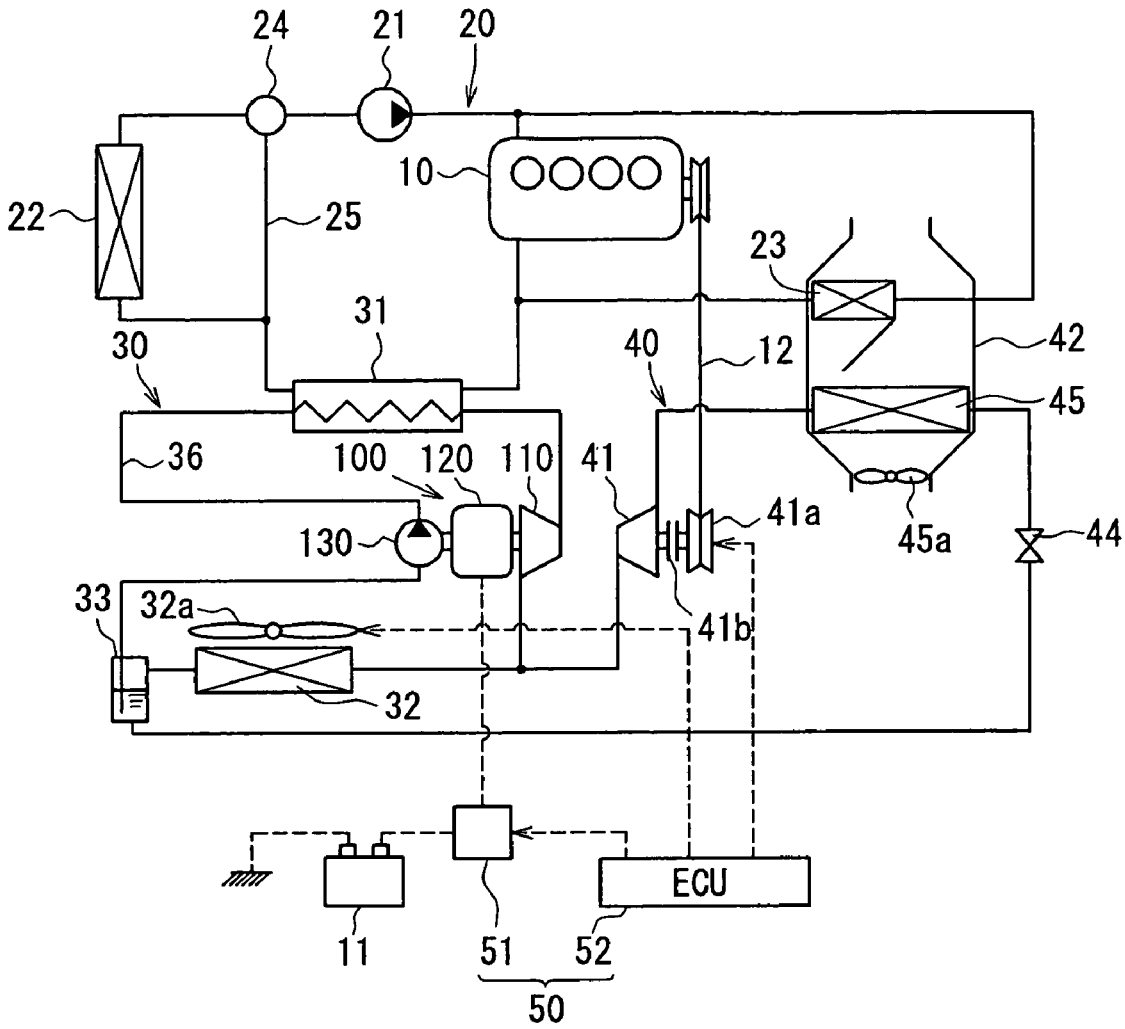
FIG. 15 is a schematic view showing a system structure according to a fifth embodiment of the present invention.

According to the embodiment, the pump-expansion-generator device 100 is applied to the Rankine cycle 30, in which the condensing device 32 and a gas-liquid separator 33 for a vehicle refrigerating cycle 40 are commonly used. The system structure will be explained with reference to FIG. 15.

At first, the refrigerating cycle 40 will be briefly explained. The refrigerating cycle 40 transfers heat from a low temperature side to a high temperature side, so that cold heat and hot heat are used for an air conditioning operation. A compressor device 41, the condensing device 32, the gas-liquid separator 33, a depressurizing device 44, and an evaporator 45 are sequentially connected in a circuit.

A driving force of the vehicle engine 10 is transmitted to the compressor device 41 via a driving belt 12, a pulley 41*a*, and an electromagnetic clutch 41*b*, so that the compressor device 41 is operated to compress the refrigerant in the refrigerating cycle 40 to the high temperature and high pressure refrigerant. The condensing device 32 is a heat exchanger for cooling down the refrigerant compressed by the compressor device 41 to the high temperature and high pressure refrigerant, to condense and liquidize the refrigerant. A fan 32*a* blows cooling air (vehicle outside air) toward the condensing device 32. The gas-liquid separator 33 is a receiver for separating the refrigerant condensed at the condensing device 32 into a gas-phase refrigerant and a liquid-phase refrigerant, to flow out the liquid-phase refrigerant.

The depressurizing device 44 is an expansion valve for depressurizing and expanding the liquid-phase refrigerant separated at the gas-liquid separator 33. The evaporator 45 is a heat exchanger for performing a heat absorbing operation by evaporating the refrigerant depressurized by the depressurizing device 44, and the evaporator 45 is provided in an A/C unit casing 42. And the air (outside or inside air) introduced into the A/C unit casing 42 by a fan 45*a* is cooled down.

The Rankine cycle 30 collects energy (the driving force generated at the expansion device 110) from waste heat generated at the engine 10. The Rankine cycle 30 is formed such that the condensing device 32 and the gas-liquid separator 33 of the refrigerating cycle 40 are commonly used for the Rankine cycle 30. A bypass passage 36, which bypasses the condensing device 32 and the gas-liquid separator 33, is provided. The refrigerant pump 130, the heating device 31, and the expansion device 110 are arranged in the bypass passage 36 from a side of the gas-liquid separator 33, and connected to the condensing device 32, so that the Rankine cycle 30 is formed.

A heater core 23 is provided in the hot water circuit 20, in addition to the water pump 21 and the radiator 22, to heat the air for air conditioning operation by use of the engine cooling water (hot water) as a heating source. The heater core 23 is arranged in the A/C unit casing 42 together with the evaporator 45, so that the air for the air conditioning operation is adjusted at a temperature set by a passenger.

The control unit 50 is provided for controlling the operations of the respective components for the refrigerating cycle 40 and the Rankine cycle 30. The control unit 50 has the inverter 51 and the controller 52.

The controller 52 controls the electromagnetic clutch 41*b*, the fan 32*a*, a pressure equalizing valve (an electromagnetic valve 117*e* (FIG. 16)) in the expansion device 110, and so on, when operating the refrigerating cycle 40 and the Rankine cycle 30, in addition to the control of the operation for the inverter 51.

Figure 16:
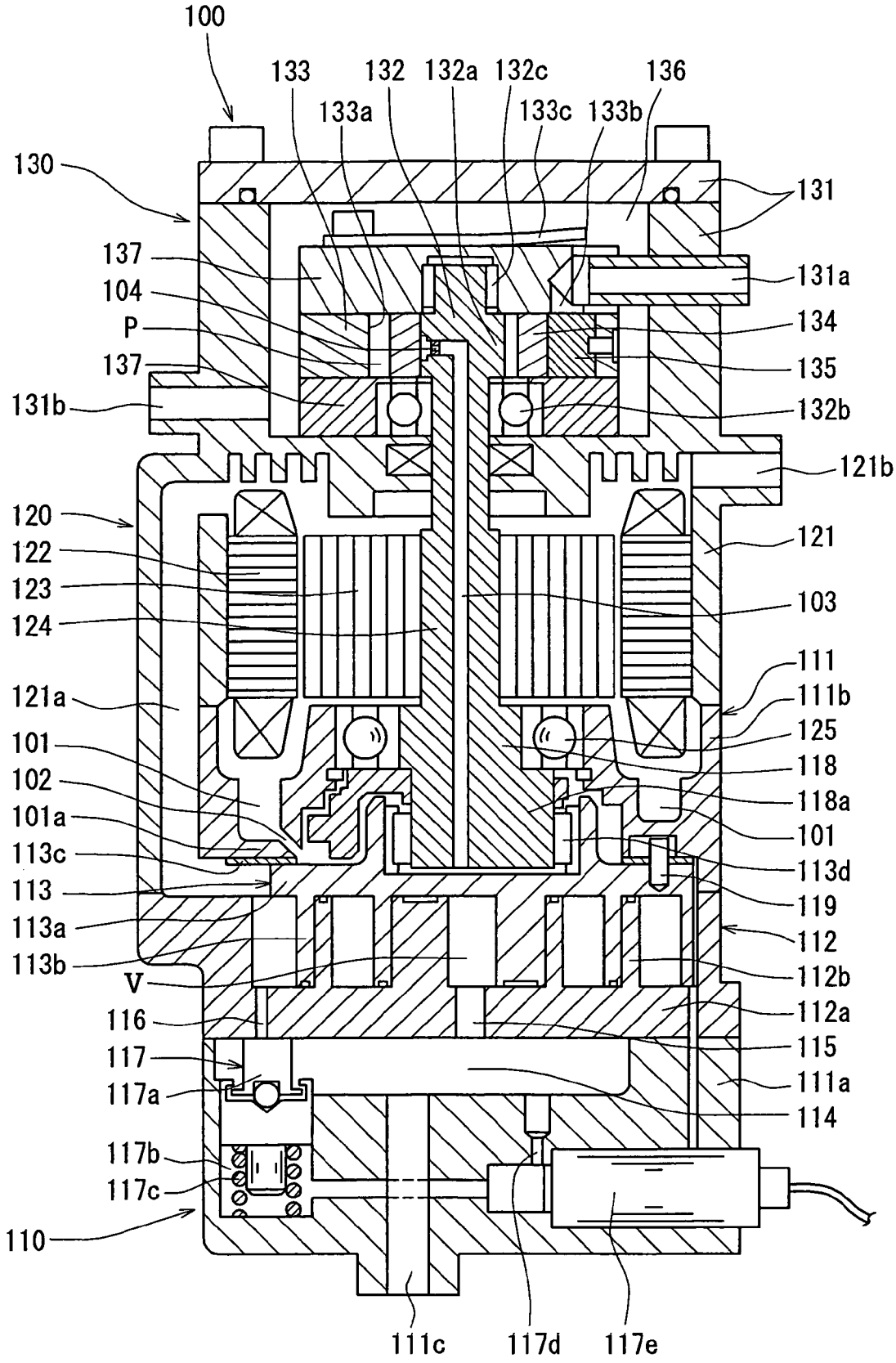
FIG. 16 is a cross sectional view showing a fluid machine (an integrated machine of a refrigerant pump, an expansion device and an electric power generating device) according to the fifth embodiment of the present invention.

Now, the structure of the pump-expansion-generator device 100 will be explained with reference to FIG. 16. The pump-expansion-generator device 100 has almost the same structure to the pump-expansion-generator device 100 shown in FIG. 2. The expansion device 110, the motor generator 120, and the refrigerant pump 130 are coaxially connected and integrally formed.

The expansion device 110 comprises the inlet port 115 for connecting the high pressure chamber 114 with the working chamber V, the pressure equalizing valve 117 for opening and closing a communication port 116, and so on.

The sliding plate 113*c* is interposed between the movable scroll 113 and a shaft housing 111*b*, and as explained below, the lubricating oil contained in the refrigerant is supplied to the sliding plate 113*c* for facilitating the smooth movable movement of the movable scroll 113.

The shaft 118 is rotatably supported by the bearing 125 fixed to the shaft housing 111*b*.

The low pressure port 121*b* is provided at the upper portion (i.e. on the side to the refrigerant pump 130) of the motor housing 121 (corresponding to the housing of the present invention), for connecting the expansion device 110 to the condensing device 32. The discharged gas passage 121*a* (which corresponds to a fluid passage of the present invention) is formed at the side wall of the motor housing 121 opposite to the low pressure port 121*b*, wherein the discharged gas passage 121*a* extends from the low pressure side (i.e. the outer peripheral portion of the scroll) upwardly through the motor housing 121. Accordingly, the low pressure port 121*b* and the low pressure side (i.e. the outer peripheral portion of the scroll) of the expansion device 110 are communicated with each other through the discharged gas passage 121*a* as well as the inside space of the motor housing 121.

The pressure equalizing valve 117 is such a valve for safely and surely stopping the operation of the expansion device 110, when an abnormal operation (for example, an abnormal rotation of the motor generator 120, an incapable situation for controlling the motor generator 120) occurs in the Rankine cycle 30. This is done by forcibly opening the communication port 116 connecting the high pressure chamber 114 with the low pressure side of the scrolls 112 and 113, so that the operation for expanding the super heated steam of the refrigerant may not be carried out in the working chamber V. The pressure equalizing valve 117 comprises a valve body 117*a* biased by a spring 117*c* provided in a back pressure chamber 117*b*, an orifice 117*d* having a certain flow resistance and communicating the back pressure chamber 117*b* with the high pressure chamber 114, and the electromagnetic valve 117*e* for adjusting the pressure in the back pressure chamber 117*b* by opening or closing the back pressure chamber 117*b* to or from the side of the high pressure chamber 114 or the low pressure side.

The on-off operation of the electromagnetic valve 117*e* is controlled by the controller 52. When the low pressure side of the electromagnetic valve 117*e* is opened, the pressure in the back pressure chamber 117*b* is released to the low pressure side, so that the pressure becomes lower than that of the high pressure chamber 114. The valve body 117*a* is displaced by the pressure of the high pressure chamber 114 in the downward direction in FIG. 16, while compressing the spring 117*c*, so that the communication port 116 is opened.

The refrigerant pump 130 is a one-stage pump of the rolling piston type. The refrigerant pump 130 is arranged at the side of the motor generator 120 opposite to the expansion device 110, and is accommodated in the pump housing 131 fixed to the motor housing 121.

According to the pump-expansion-generator device 100, such a means is provided for pooling the lubricating oil circulated in the pump-expansion-generator device 100 together with the refrigerant and for increasing the viscosity of the lubricating oil and supplying the lubricating oil to the sliding portions.

Namely, the oil pooling portion 101 is provided above the expansion device 110 but below the motor generator 120, for pooling the lubricating oil separated from the refrigerant. More exactly, the oil pooling portion 101 is formed into a groove shaped portion, at a side of the shaft housing 111*b* further lower than the lower end of the stator 122 of the motor generator 120, namely closer to the sliding plate 113*c* as the sliding portion of the expansion device 110. The groove shaped portion is formed by digging up a part of the shaft housing 111*b*.

A lower end of the shaft housing is formed as a partitioning portion 101*a* between the oil pooling portion 101 and the sliding plate 113*c*. A thickness of the partitioning portion 101*a* is made thinner than that of other portions of the shaft housing 111*b*. An oil passage 102 is formed at the partitioning portion 101*a* as such a passage for communicating the bottom portion of the oil pooling portion 101 with an upper portion of the sliding plate 113*c*.

The shaft passage 103 is formed in the inside of the shaft 118, the motor shaft 124, and the pump shaft 132, which are integrally formed with one another, such that the longitudinal end portion of the crank portion 118*a* is communicated with the outer peripheral portion of the cam portion 132*a*. An orifice 104 having a certain flow resistance is formed in the shaft passage 103 at such a position, which is closer to the outer peripheral portion of the cam portion 132*a*, Now, an operation and advantage of the pump-expansion-generator device 100 according to the embodiment will be explained.

In the case that sufficient amount of waste heat can be obtained from the engine 10 (namely, when the temperature of the engine cooling water is sufficiently high), the controller 52 operates the motor generator 120 as the electric motor by supplying the electric power from the inverter 51 to the motor generator 120, so that the expansion device 110 and the refrigerant pump 130 are operated, when starting up the Rankine cycle 30. Then, the refrigerant is sucked from the gas-liquid separator 33 and supplied to the heating device 31, so that the supplied refrigerant is heated by the heating device 31.

The super heated steam of the refrigerant, which is heated by the heating device 31 to the high temperature and high pressure, is introduced into the working chamber V of the expansion device 110 and expanded therein. When the movable scroll 113 is rotated by the expansion of the super heated steam of the refrigerant, the motor generator 120 and the refrigerant pump which are connected to the movable scroll 113 are driven. When the driving force of the expansion device 110 exceeds a driving power for driving the refrigerant pump 130, the motor generator 120 is operated as the electric power generator, so that the controller 52 charges the electric power generated by the motor generator 120 into the battery 11 through the inverter 51.

The low pressure refrigerant, the pressure of which is decreased after having ended with the expansion at the expansion device 110, is circulated through the condensing device 32, the gas-liquid separator 33, the bypass passage 36, the refrigerant pump 130, the heating device 31, and the expansion device 110 (the circulation in the Rankine cycle 30).

The controller 52 surely stops the operation of the expansion device 110, by opening the pressure equalizing valve 117 so as not to introduce the super heated steam of the refrigerant into the working chamber V, when any abnormal operation occurs in the Rankine cycle 30. In the case that the air conditioning operation is required by the passenger, the pulley 41*a* is connected to the compressor device 41 by means of the electromagnetic clutch 41*b*, so that the compressor device 41 is driven by the driving force of the engine 10 to perform the air conditioning operation by the refrigerating cycle 40. In addition, the rotational speed of the fan 32*a* is controlled to adjust the capacity for the condensing performance of the condensing device 32.

According to the above the pump-expansion-generator device 100, the super heated steam of the refrigerant, which is heated by the heating device 31 to the high pressure steam, flows into the high pressure chamber 114 through the high pressure port 111*c* during the normal operation of the Rankine cycle 30. The refrigerant flows through the inlet port 115, the working chamber V, the low pressure sides (the outer peripheral sides) of the scrolls 112, 113, the discharged gas passage 121*a*, the inside space of the motor housing 121, and the low pressure port 121*b*, and flows to the condensing device 32.

When the super heated steam of the refrigerant flows from the discharged gas passage 121*a* into the motor housing 121, flow speed thereof is decreased due to the enlargement of the flow passage, and the lubricating oil is separated from the refrigerant. Namely, the discharged gas passage 121*a* and the motor housing 121 function as a separating means for separating the lubricating oil from the refrigerant, in the present embodiment. The separated lubricating oil goes down due to its own weight through windings of the stator 122, the rotor 123 of the motor generator 120, or spaces between the parts, and pooled in the oil pooling portion 101 at the lowermost position. The lubricating oil pooled in the oil pooling portion 101 is heated by receiving heat (by the heat transfer) from the working chamber V and the high pressure chamber 114 of the expansion device 110, which is a high temperature portion (i.e. an area of the high temperature side).

When the lubricating oil is heated as above, the refrigerant contained in the lubricating is vaporized so that the viscosity of the lubricating oil is increased. For example, the refrigerant expanded and discharged from the expansion device 110, which is operating at the temperature of 80° C., is at 1.0 MPa and 45° C. under the circumstance of the ambient temperature of 25° C. Under this condition, 40% (mass fraction) of the refrigerant is melt in the lubricating oil. Therefore, the viscosity of the lubricating oil is decreased to about a value of 7 cst. When the lubricating oil is heated, however, to a temperature of 60° C., more than half of the lubricating is vaporized, and the viscosity is increased to a value of 10 cst, which is appropriate value of the viscosity for the expansion device 110.

The lubricated oil, which is heated and the viscosity of which is increased, further flows down due its weight through the oil passage 102. Furthermore, the lubricating oil is sucked by a pressure difference between the expansion device 110 and the refrigerant pump 130, so that it flows to the sliding plate 113*c* and the bearing 113*d* of the sliding portions of the expansion device 110. Then, the lubricating oil further flows to the bearings 132*b* and 132*c* of the sliding portions from the rotor 134 of the refrigerant pump 130, through the shaft passage 103. The lubricating oil reaching the bearings 132*b* and 132*c* is again melt in the liquid-phase refrigerant in the pump chambers P of the refrigerant pump 130, so that the lubricating oil is repeatedly circulated in the Rankine cycle 30. The amount of the lubricating oil flowing through the shaft passage 103 is adjusted by the orifice 104. Namely, although the refrigerant is allowed to flow through the shaft passage 103, a large amount of the lubricating oil may not flow, due to its flow resistance, from the motor housing 121 to directly into the refrigerant pump 130 through the shaft passage 103.

As above, according to the pump-expansion-generator device 100 of the embodiment, the discharged gas passage 121*a* is provided for introducing the refrigerant pumped out from the expansion device 110 to the upper portion of the motor housing 121. When the refrigerant flows into the space of the motor housing 121 from the discharged gas passage 121*a*, the lubricating oil contained in the refrigerant is separated from the refrigerant due to the decrease of the flow speed of the refrigerant. In addition, the oil pooling portion 101 and the oil passage 102 are provided. As the lubricating oil separated from the refrigerant in the motor housing 121 downwardly flows due to its weight, the lubricating oil does not flow out to the outside of the motor housing 121 along the refrigerant flow. Accordingly, the lubricating oil can be surely pooled in the oil pooling portion 101. Then, the lubricating oil can be heated in the oil pooling portion 101 to vaporize the refrigerant contained in the lubricating oil. As a result, the lubricating oil having the higher viscosity can be supplied to the sliding plate 113*c* and the bearing 113*d* of the expansion device 110 through the oil passage 102.

A thickness of an oil film depends on the viscosity of the lubricating oil. Direct contacts of the parts can be avoided by the oil film, when the sufficient viscosity is assured, without strict polish finish at the sliding portions for the surface roughness. Accordingly, the reliability of the expansion device 110 can be obtained even by a reasonable machining process. In addition, an abnormal wear may not occur at the bearing (113*d*) before its life duration, when the bearing is used in the atmosphere of the high viscosity. Accordingly, the reliability can be assured even with such bearing of a reasonable cost.

The thickness of the partitioning portion 101*a*, which partitions the oil pooling portion 101 and the high temperature portion (the working chamber V, the high pressure chamber 114), is made smaller than that of the other portions, so that the heat resistance at the partitioning portion 101*a* is decreased to improve the heat transferring performance from the high temperature portion to the oil pooling portion 101.

The refrigerant discharged from the expansion device 110 and flowing into the motor housing 121 goes down due to its own weight through windings of the stator 122, the rotor 123 of the motor generator 120, or spaces between the parts. Accordingly, the lubricating oil can be heated by the heat generated at the stator 122 and the rotor 123 during their operation, the refrigerant contained in the refrigerant can be also vaporized during the flow so that the viscosity of the lubricating oil can be increased even before reaching the oil pooling portion 101.

Furthermore, the shaft passage 103 is provided so that the lubricating oil is drawn toward the refrigerant pump 130 by the pressure difference between the expansion device 110 and the refrigerant pump 130. The lubricating oil can be smoothly and surely supplied to the sliding portions (113*c*, 113*d*). The lubricating oil of the high viscosity can be supplied to the refrigerant pump 130.

Sixth Embodiment

Figure 17:
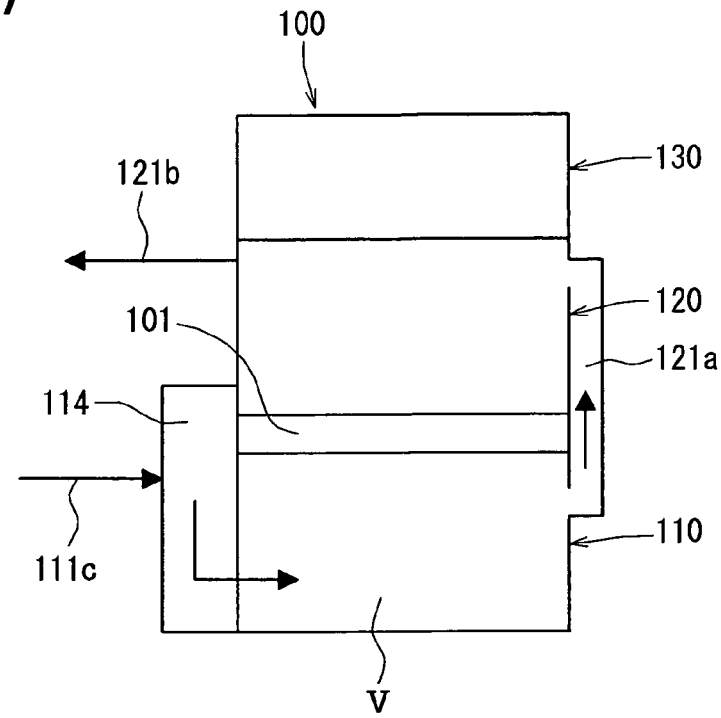
FIG. 17 is a cross sectional view showing a fluid machine (an integrated machine of a refrigerant pump, an expansion device and an electric power generating device) according to a sixth embodiment of the present invention.

A sixth embodiment of the present invention is shown in FIG. 17. In the sixth embodiment when compared with the fifth embodiment, the high pressure chamber (the area of the high pressure side) 114 of the expansion device 110 is mainly used as the high temperature portion to the oil pooling portion 101. More exactly, the high pressure chamber 114 is arranged at a side portion of the expansion device 110, so that the high pressure chamber 114 is closer to the oil pooling portion 101.

With such an arrangement, the lubricating oil in the oil pooling portion 101 can be heated by such super heated steam of the refrigerant, which is in the high temperature condition higher than that of the refrigerant in the working chamber V. Accordingly, the refrigerant contained in the lubricating oil can be more effectively vaporized than the fifth embodiment.

Seventh Embodiment

Figure 18:
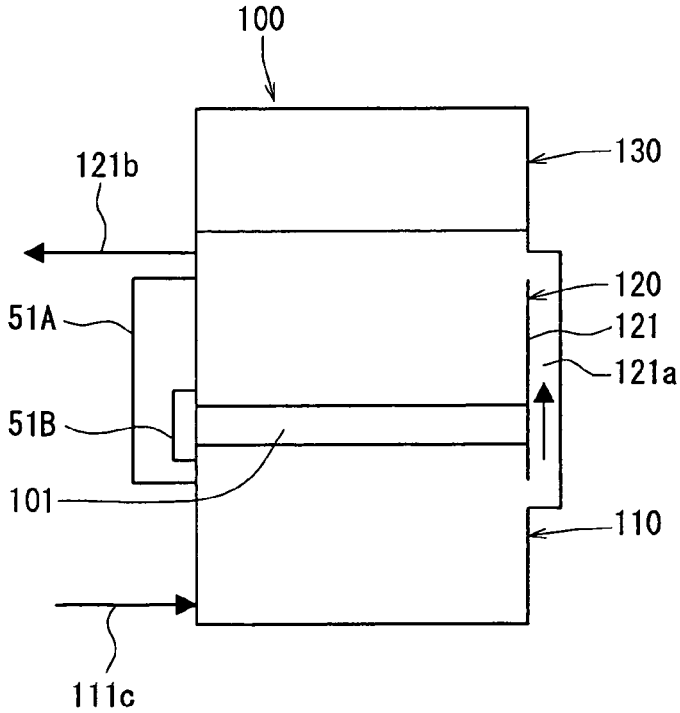
FIG. 18 is a cross sectional view showing a fluid machine (an integrated machine of a refrigerant pump, an expansion device and an electric power generating device) according to a seventh embodiment of the present invention.

A seventh embodiment of the present invention is shown in FIG. 18. In the seventh embodiment when compared with the fifth embodiment, the inverter 51A for the motor generator 120 is used as the high temperature portion for heating the lubricating oil pooled in the oil pooling portion 101.

The inverter 51A is integrally formed at the outer peripheral portion of the motor housing 121 of the motor generator 120. A heat generating portion 51B of the inverter 51A is arranged to be closer to the oil pooling portion 101.

With such an arrangement, the inverter 51A (the heat generating portion 51B) is used as the heat source, without limiting to the area of the high pressure side of the expansion device 110, to heat the lubricating oil in the oil pooling portion 101.

Eighth Embodiment

Figure 19:
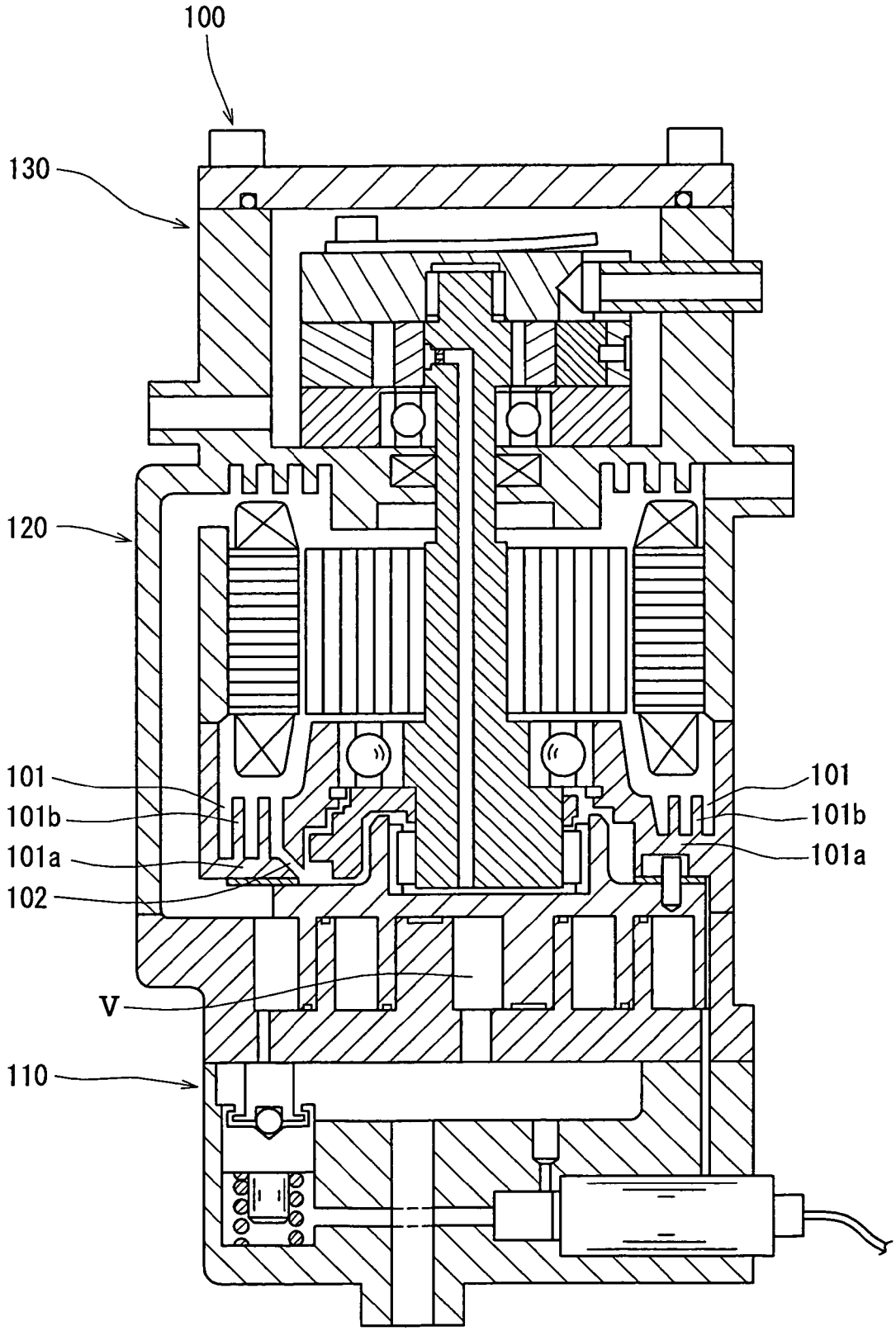
FIG. 19 is a cross sectional view showing a fluid machine (an integrated machine of a refrigerant pump, an expansion device and an electric power generating device) according to an eighth embodiment of the present invention.

An eighth embodiment of the present invention is shown in FIG. 19. In the eighth embodiment, fins 101*b* are provided at an inner surface of the oil pooling portion 101 of the fifth embodiment, for enlarging an area of heat transfer (contact area). The fins 101*b* are formed as multiple thin metal sheets upwardly extending from the partitioning portion 101*a*, which is the bottom portion of the oil pooling portion 101.

With such an arrangement, the heat from the high temperature portion (the working chamber V) can be effectively transferred to improve the effect of vaporization for the refrigerant.

Ninth Embodiment

Figure 20:
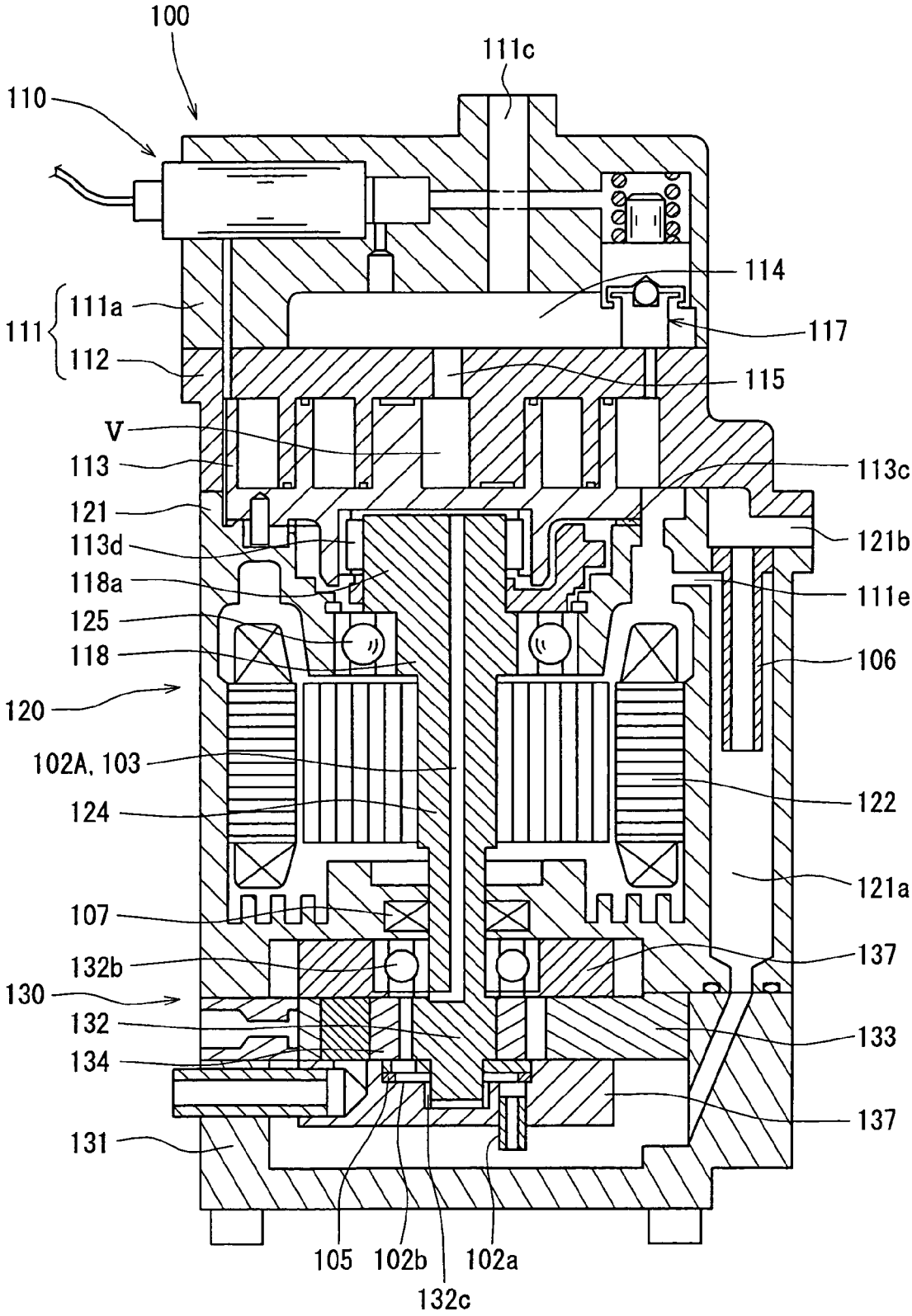
FIG. 20 is a cross sectional view showing a fluid machine (an integrated machine of a refrigerant pump, an expansion device and an electric power generating device) according to a ninth embodiment of the present invention.

A ninth embodiment of the present invention is shown in FIG. 20. In the ninth embodiment, the positions of the expansion device 110, the motor generator 120, and the refrigerant pump 130 of the pump-expansion-generator device 100 are changed and a structure for supplying the lubricating oil to the sliding portions of the expansion device 110 and the refrigerant pump 130 is changed, when compared with the fifth embodiment.

As shown in FIG. 20, the expansion device 110, the motor generator 120, and the refrigerant pump 130 are arranged in this order from the top to the bottom of the pump-expansion-generator device 100. The housing 111 of the expansion device 110 comprised the front housing 111*a* and the fixed scroll 112. The low pressure side of the scrolls 112 and 113 is communicated with the inside space of the motor housing 121 (the space above the stator 122).

The discharged gas passage 121*a* (corresponding to the fluid passage of the present invention) is vertically extending and formed at the side wall of the motor housing 121 of the motor generator 120. The upper end of the discharged gas passage 121*a* forms the low pressure port 121*b*, opening to the outside of the fluid machine 100. The discharged gas passage 121*a* is communicated with the inside of the motor housing 121 through a communication port 111*e*, formed at the motor housing 121 directly below the low pressure port 121*b*.

A centrifugal separator 106 is provided between the communication port 111*e* and the low pressure port 121*b*. The centrifugal separator 106 vertically extends and has a pipe shaped element having a diameter smaller than the inner diameter of the discharged gas passage 121*a*. A large diameter portion is formed at the upper end of the pipe shaped element, so that the outer peripheral surface of the large diameter portion is brought into contact with the inner peripheral surface of the discharged gas passage 121*a* to close a passage between the communication port 111*e* and the low pressure port 121*b*. However, the communication port 111*e* and the low pressure port 121*b* are communicated with each other through the inside space of the pipe shaped element. The lower end of the discharged gas passage 121*a* is communicated with the oil pooling portion 101, which is formed at a lower side of the refrigerant pump 130, as explained below.

In the refrigerant pump 130, the lower side space of the pump housing 131 is formed as the oil pooling portion 101. The cylinder block 133 is interposed between the end plates 137. A recess-shaped pump accommodating portion 102*b* is formed at the upper side of the lower end plate 137, opposing to the rotor 134 (the shaft supporting portion of the rotor 134). An oil pump 105, which is driven by the rotation of the pump shaft 132, is provided in the pump accommodating portion 101*b*. The oil pump 105 is formed as the trocoid type pump, wherein an external gear (of an inner rotor) is engaged with an internal gear (of an outer rotor) and the inner and outer rotors are rotated to pump out the fluid (the lubricating oil). A pipe 102*a* is formed in the end plate 137 for communicating the oil pooling portion with the pump accommodating portion 102*b*.

The shaft passage 103 is formed in the inside of the shaft 118, the motor shaft 124, and the pump shaft 132, which are integrally formed with one another, so that the shaft passage 103 connects the upper portion of the rotor 134 with the longitudinal end portion of the crank portion 118*a*. The lower end portion of the shaft passage 103 is communicated with the side of the rotor 134, whereas the upper end portion thereof is communicated with the inside space of the motor housing 121 through the bearing 113*d* and the bearing 125.

The pipe 102*a*, the pump accommodating portion 102*b*, the oil pump 105, the rotor 134, the shaft passage 103, and the inside space of the motor housing 121 are consecutively communicated to form an oil passage 102A. In addition, the motor housing 121, the communication port 111*e*, the discharged gas passage 121*a*, and the oil pooling portion 101 are consecutively communicated to the oil passage 102A, to form a circulation passage for the lubricating oil.

An oil seal 107 is provided on the motor shaft 124 (i.e. the pump shaft 132) between the motor generator 120 and the refrigerant pump 130, to seal the both components 120 and 130 from each other for preventing the lubricating oil from flowing from one to the other.

Now, an operation and advantage of the pump-expansion-generator device 100 according to the embodiment will be explained.

According to the pump-expansion-generator device 100, the super heated steam of the refrigerant, which is heated by the heating device 31, flows into the high pressure chamber 114 through the high pressure port 111*c*, and further flows into the inside space of the motor housing 121 via the inlet port 115, the working chamber V, and the low pressure sides of the scrolls (the outer peripheral portion of the scrolls), when the Rankine cycle 30 is in its operation.

The super heated steam of the refrigerant flows into the discharged gas passage 121*a* from the inside space of the motor housing 121 through the communication port 111*e*. The super heated steam of the refrigerant downwardly flows in the discharged gas passage 121*a*, wherein the refrigerant is swirled along the outer peripheral surface of the centrifugal separator 106. Since the lubricating oil contained in the refrigerant has a larger weigh volume ratio than the refrigerant, the lubricating oil is separated from the refrigerant and gathered at the inner peripheral surface of the discharged gas passage 121*a*. Then, the lubricating oil further flows down due to its weight and is pooled in the oil pooling portion 101. The refrigerant, from which the lubricating oil is separated by the centrifugal separator 106, flows out from the low pressure port 121*b* through the inner space of the pipe shaped element of the centrifugal separator 106.

The lubricating oil pooled in the oil pooling portion 101 is sucked through the pipe 102*a* by the oil pump 105, which is driven by the rotation of the pump shaft 132. The lubricating oil flows into the shaft passage 103 through the shaft supporting portion for the rotor 134. The lubricating oil is supplied to the bearings 132*b* and 132*c* in the above flow of the lubricating oil.

The lubricating oil flowing through the shaft passage 103 is supplied to the bearing 113*d* and the bearing 125 and flows into the inside space of the motor housing 121. In this operation, the lubricating oil flows into the super heated steam of the refrigerant, which is discharged from the expansion device 110 and flowing into the inside space of the motor housing 121, so that the lubricating oil is heated to increase the viscosity of the lubricating oil. The lubricating oil flows together with the super heated steam of the refrigerant into the discharged gas passage 121*a* through the communication port 111*e*. The lubricating oil and the refrigerant reaching at the centrifugal separator 106 are separated from each other again, to repeat the above circulation of the lubricating oil.

According to the above arrangement, in which the expansion device 110, the motor generator 120, and the refrigerant pump 130 are arranged in this order from the top, the circulation passage is formed by the discharged gas passage 121*a* communicated with the inside space of the motor housing 121 and the oil passage 102A, so that the lubricating oil is circulated by the oil pump 105. And the lubricating oil from the oil passage 102A is heated at the intersecting point in the inside of the motor housing 121 by the high temperature refrigerant discharged from the expansion device 110, to increase the viscosity of the lubricating oil. Accordingly, the lubricating oil having the higher viscosity can be supplied to the sliding portions (the bearings 113*d*, 125) of the expansion device 110 and the sliding portions (the bearings 132*b*, 132*c*) of the refrigerant pump 130.

The shaft passage 103 is formed in the inside of the shaft 118, the motor shaft 124, and the pump shaft 132, which are integrally formed with one another, so that the shaft passage 103 connects the upper portion of the rotor 134 with the longitudinal end portion of the crank portion 118*a*. Accordingly, the oil passage 102A can be easily formed.

As the super hated steam of the refrigerant is depressurized by the centrifugal separator 106, the pressure difference appears between the inside of the motor housing 121 and the inside of the pump housing 131 (namely, the pressure in the motor housing 121 is higher than that in the pump housing 131). However, the lubricating oil may not be leaked from the side of the motor generator 120 to the side of the refrigerant pump 130, because the oil seal 107 is provided between the motor generator 120 and the refrigerant pump 130.

(Other Modifications)

An oil separating means, such as a centrifugal separating means can be provided between the discharge side of the expansion device 110 and the oil pooling portion, in order to actively separate the lubricating oil from the refrigerant discharged from the expansion device 110. And the lubricating oil separated by the oil separating means may be pooled in the oil pooling portion, so that the viscosity of the lubricating oil can be further effectively increased.

The heat generating portion 51B of the inverter 51A, explained in the above seventh embodiment, may be provided in the intermediate portion of the motor housing 121, so that the refrigerant flowing through the coils of the stator 122 or the rotor 123 or the spaces between the parts and going down due to its weight may be heated.

In the above embodiments, the expansion device 110 is formed by the scroll type device and the refrigerant pump 130 is formed by the rolling piston type device. However, the present invention may not be limited to those types. A gear pump type, a trochoid type, or any other types may be used.

In the above embodiments, the engine 10 for the vehicle (the engine cooling water) is used as the heating source for the heating device 31. Any other devices, which generates heat for its operation and throws away a part of the heat for the purpose of its temperature control (i.e. which generates waste heat), such as an external combustion engine, fuel cell stacks for a fuel cell car, various kinds of motors, and the inverter, can be widely used to the present invention.

Tenth Embodiment

Figure 21:
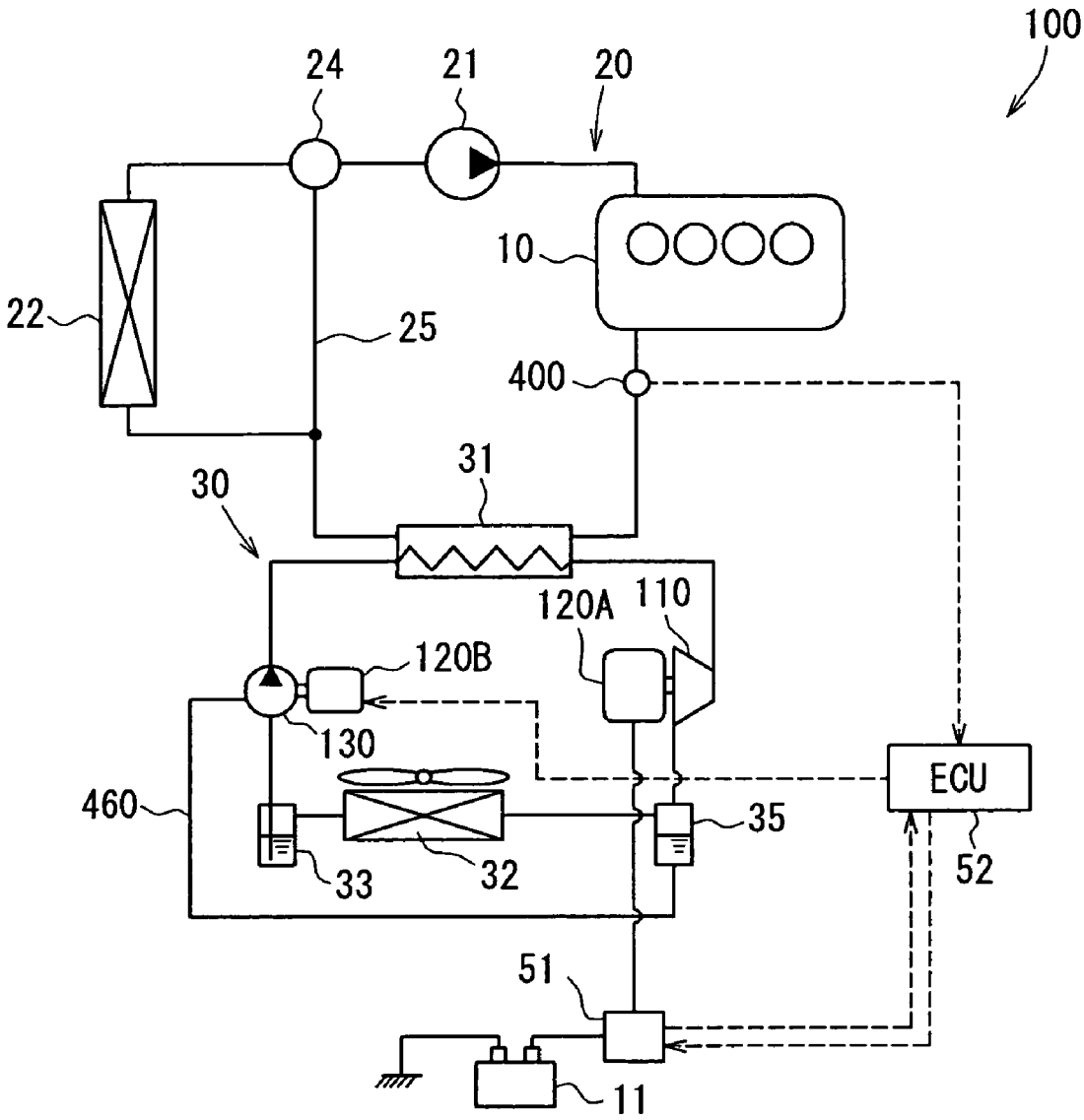
FIG. 21 is a schematic view showing an entire structure of a waste heat utilizing system according to a tenth embodiment of the present invention.
Figure 22:
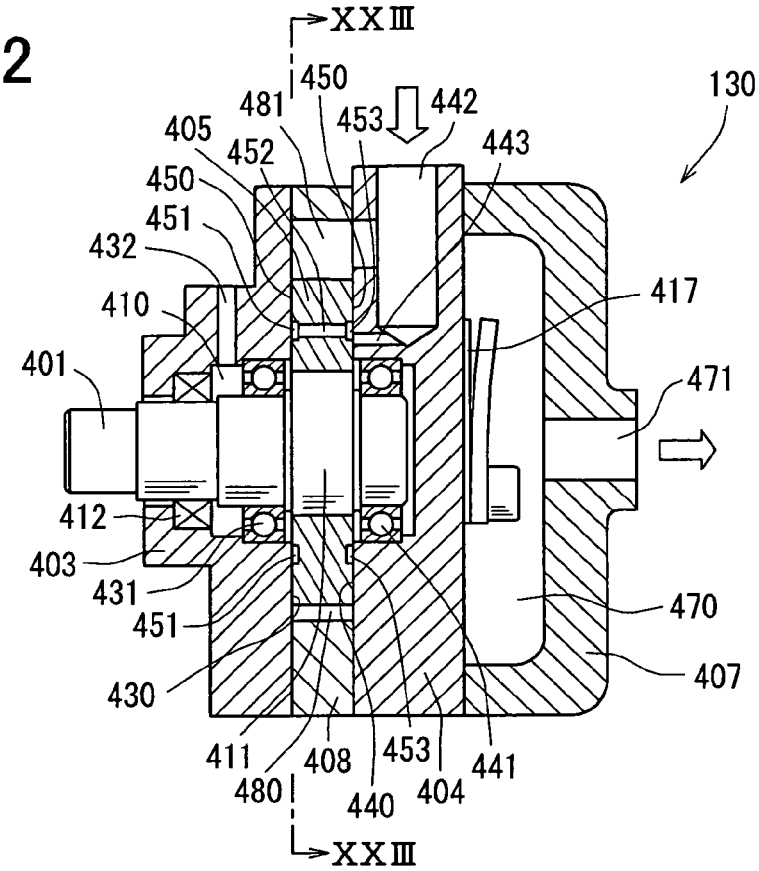
FIG. 22 is a cross sectional view showing a detailed structure of a refrigerant pump of the tenth embodiment.
Figure 23:
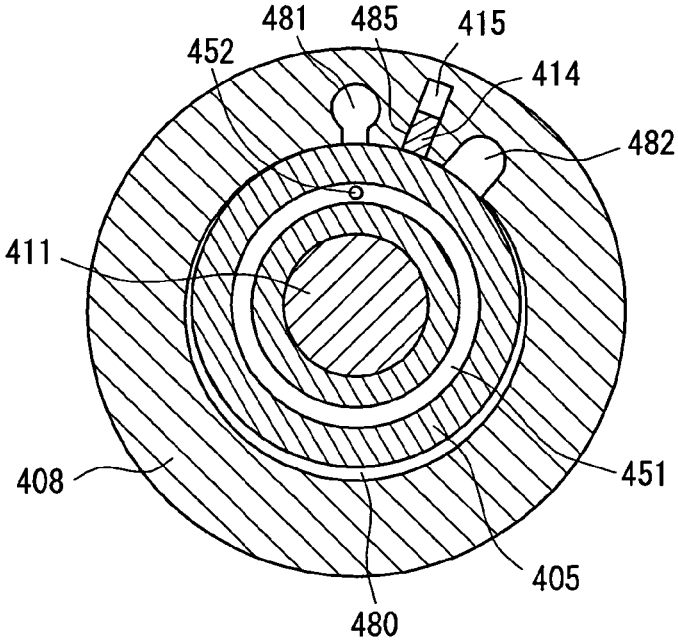
FIG. 23 is a cross sectional view taken along a line XXIII-XXIII in FIG. 22.

A tenth embodiment of the present invention is shown in FIGS. 21 to 23.

A total structure of a waste heat utilizing apparatus 100 will be explained with reference to FIG. 21 by focusing on the differences with the structure of FIG. 1.

A temperature sensor 400 is provided in the hot water circuit 20 at a downstream side of the engine 10, for detecting temperature of the engine cooling water. A temperature signal of the temperature sensor 400 is inputted to the control unit 52.

The Rankine cycle 30 comprises the heating device 31, the expansion device 110, a separator 35, the condensing device 32, a receiver 33, and the refrigerant pump 130, wherein those components are consecutively connected in a closed circuit. The refrigerant is circulated by the refrigerant pump 130 in the closed circuit. HFC134a is used as the refrigerant for the Rankine cycle 30 in the embodiment.

The refrigerant pump 130 is of an electric motor driven type, in which the pump is driven by an electric motor 120B (corresponding to an external driving source) and the operation of the electric motor 120B is controlled by the control unit 52. A detailed structure of the refrigerant pump 130 will be explained below.

The expansion device 110 is a fluid machine for generating the driving force by the expansion of the super heated steam of the refrigerant produced at the heating device 31. The expansion device 110 is connected to the electric power generator 120A, so that the electric power generator 120A is operated by the driving force of the expansion device 110 and the electric power generated at the electric power generator 120A is charged into the battery 11 by the control circuit 51.

The separator 35 separates the oil from the gas-phase refrigerant at the outlet side of the expansion device 110. The oil separated at the separator 35 is supplied to the refrigerant pump 130 through an oil supply passage 460. The oil is used as the lubricating oil in the refrigerant pump 130. The details will be explained below.

The condensing device 32 is a heat exchanger for cooling down the gas-phase refrigerant supplied from the outlet of the expansion device 110 through the separator 35, by the heat exchange with the external air, and liquefying the refrigerant.

The receiver 33 is a receiver for separating the refrigerant condensed at the condensing device 32 into the gas-phase and the liquid-phase refrigerants and flows out the liquid-phase refrigerant.

The control unit 52 controls the total operation of the waste heat utilizing apparatus 100, including the operation of the Rankine cycle 30. The control circuit 51 is connected to the control unit 52, so that control signals are mutually transmitted to each other. The temperature signal for the engine cooling water from the temperature sensor 400 is inputted to the control unit 52.

Now, the detailed structure of the refrigerant pump 130 will be explained with reference to FIGS. 22 and 23. FIG. 22 is a cross sectional view showing the inside structure of the refrigerant pump 130, and FIG. 23 is a cross sectional view taken along a line XXIII-XXIII in FIG. 22.

The refrigerant pump 130 is a so-called rolling piston type pump, which is composed of a flat annular cylinder 408 forming therein a cylinder chamber 480, a ring shaped piston 405, and a shaft 401 for driving the ring shaped piston 405.

The cylinder 408 is sandwiched between a front housing 403 and a rear housing 404, wherein side wall portions 430 and 440 (corresponding to end wall portion of the present invention) are formed at both sides of the cylinder 408. A rear plate 407 is provided at the rear housing 404, at the opposite side to the cylinder 408, so that a discharge chamber 470 is formed.

The cylinder chamber 480 is formed in the center of the cylinder 408. The ring shaped piston 405 is formed into a flat annular shape, wherein the outer diameter is made smaller than an inner diameter of the cylinder 408, so that the piston 405 is inserted into the cylinder chamber 480.

The shaft 401 is rotatably supported by bearings 431 and 441 respectively fixed to the front housing 403 and the rear housing 404. The shaft 401 is connected to and driven by the electric motor 120B. The shaft 401 has an annular crank portion (shaft) 411 (corresponding to an eccentric portion of the present invention), which is eccentric with respect to the shaft 401. The ring shaped piston 405 is slidably provided at an outer peripheral portion of the crank portion (shaft) 411, so that the ring shaped piston 405 is rotated in the cylinder chamber 480 with an orbital motion in accordance with the rotation of the shaft 401.

A space is formed around the shaft 401 from the front housing 403 to the rear housing 404 such that the space covers the sliding surfaces between the crank portion (shaft) 411 and the ring shaped piston 405, which is sliding portions when the refrigerant pump 130 is operated, and the bearings 431 and 441. According to the embodiment, the space is used as an oil storing chamber 410 filled with the lubricating oil. The detailed structure of the oil storing chamber 410 as well as its related parts will be explained below.

As shown in FIG. 23, a vane 414 is provided at the outer peripheral surface of the ring shaped piston 405, wherein the vane 414 is slidably inserted into a groove 485 formed in the cylinder 408 and movably held therein in a radial direction of the ring shaped piston 405. The one end of the vane 414 is in sliding contact with the outer peripheral surface of the ring shaped piston 405. A spring 415 is arranged in the groove 485 in order to bias the vane 414 toward the center of the ring shaped piston 405.

According to the above structure, the vane 414 slides within the groove 485 in accordance with the rotation of the ring shaped piston 405 in the orbital motion, and the vane is kept in the sliding contact with the outer peripheral surface of the ring shaped piston 405, so as to define a suction side chamber and a discharge side chamber. As above, a pump chamber is formed in the cylinder chamber 480 by the outer peripheral surface of the ring shaped piston 405, the inner peripheral surface of the cylinder 408, and the vane 414.

A suction passage 481 and a discharge passage 482 communicated with the cylinder chamber 480 are formed in the cylinder 408 adjacent to the vane 414, such that the vane 414 is sandwiched between the passages 481 and 482.

An inlet port 442 is formed in the rear housing 404 for sucking the refrigerant from the receiver 33 into the refrigerant pump 130. The inlet port 442 is communicated with the suction passage 481 of the cylinder 408, as shown in FIG. 22. Accordingly, the refrigerant sucked to the inlet port 442 flows into the cylinder chamber 480 through the suction passage 481.

The discharge passage 482 of the cylinder 408 is communicated with the discharge chamber 470 through a communication passage (not shown) formed in the rear housing 404. A check valve 417 is provided at an opening portion of the communication passage opening to the discharge chamber 470.

The discharge chamber 470 has a function for smoothing the pulsation of the refrigerant discharged from the cylinder chamber 480. The discharge port 471 is provided, at the rear plate of a side of the discharge chamber 470 opposite to the rear housing 404, for discharging the refrigerant to the heating device 31.

Now, the details of the oil storing chamber 410 as well as its related structure will be explained. The oil storing chamber 410 is formed around the shaft 401, such that the oil storing chamber 10 covers the sliding portions of the refrigerant pump 130. An end portion of the oil storing chamber 410 is sealed, at a side of the shaft to be connected to the electric motor 120B, by a seal member 412 disposed between the outer peripheral surface of the shaft 401 and the front housing 403.

An oil supply port 432 is formed at the front housing 403 for supplying the lubricating oil from the outside into the oil storing chamber 410. The lubricating oil lubricates the sliding surface between the crank portion 411 (as the sliding portion) and the ring shaped piston 405, and the bearings 431, 441. According to the embodiment, the oil separated from the refrigerant at the separator 35 provided at the outlet side of the expansion device 110 for the Rankine cycle 30 is directly supplied to the refrigerant pump 130 through the oil supply passage 460, so that the oil is supplied as the lubricating oil into the oil storing chamber 410 through the oil supply port.

As shown in FIGS. 22 and 23, circular grooves 451, 452 are formed on both axial side surfaces 450 (which correspond to axial side surfaces of the present invention) of the ring shaped piston 405. Diameters of the grooves 451, 452 are so selected that the grooves are positioned at the outer side of the oil storing chamber 410. In the embodiment, the groove 451 of the ring shaped piston 405 formed on the axial side surface 450 on a side to the front housing 403 corresponds to a small space, a groove portion, and a first space of the present invention. The groove 453 on a side to the rear housing 404 corresponds to a small space, a groove portion, and a second space of the present invention.

The circular grooves 451 and 453 formed on the axial side surfaces 450 of the ring shape piston 405 are communicated with each other through a communication hole 452, which is formed to penetrate the ring shape piston 405 in a direction parallel to an axial direction.

A bypass passage 443 is formed in the rear housing 404 at such a position, at which the bypass passage 443 is brought into communication with the circular grooves 451, 453 of the ring shaped piston 405. The bypass passage 443 communicates the groove 453, which is formed on the side surface 450 of the ring shaped piston 405 facing to the rear housing 404, with the inlet port 442. According to the above structure, the pressure at the grooves 451, 453 at both axial side surfaces 450 of the ring shaped piston 405 is kept at such a pressure (the pump suction pressure) equal to the pressure at the inlet port 442.

The refrigerant is supplied to the inlet port 442 from the separator 35 at the outlet side of the expansion device 110 of the Rankine cycle 30 through the condensing device 32 and the receiver 33. On the other hand, the oil separated from the refrigerant is directly supplied into the oil storing chamber 410 through the oil supply passage 460. The pressure in the oil storing chamber 410 is higher than that in the inlet port 442 (the pump suction pressure) by pressure loss at the condensing device 32 and the receiver 33.

According to the embodiment, the width of the grooves 451, 453 is 2.5 mm, the depth thereof is 1 mm, and the diameter of the communication hole is 1 mm. The refrigerant pump 130 is made of iron by means of casting, cutting, or the like.

An operation of the waste heat utilizing apparatus 100 (controlled by the control unit 52) of the embodiment will be explained. The control unit 52 starts the operation of the Rankine cycle 30, when the control unit 52 determines that the temperature of the engine cooling water detected by the temperature sensor 400 is higher than a predetermined temperature, namely when the control unit 52 determines that the temperature of the engine cooling water flowing through the heating device 31 is sufficiently high enough to obtain the waste heat from the engine 10. More exactly, the refrigerant pump 130 is started by operating the electric motor 120B.

When the Rankine cycle 30 is operated, the liquid-phase refrigerant of the receiver 33 is pressurized by the refrigerant pump 130 and supplied to the heating device 31, so that the liquid-phase refrigerant is heated by the high temperature engine cooling water having the waste heat from the engine 10. The refrigerant is heated to the super heated steam of the refrigerant and supplied to the expansion device 110. The super heated steam of the refrigerant is expanded and depressurized in an isentropic manner, such that a part of thermal energy and pressure energy is converted into a rotational driving force. The electric power generator 120A is driven by the rotational driving force generated at the expansion device 110 to generate the electric power. The electric power obtained at the electric power generator 120A is charged into the battery 11 via the control circuit 51, so that the electric power is used for operating the various accessories. The refrigerant depressurized at the expansion device 110 is condensed at the condensing device 32 after the oil is separated at the separator 35, and sucked again into the refrigerant pump 130 after the refrigerant is separated into the liquid-phase and gas-phase refrigerant by the receiver (the gas-liquid separating device) 33.

On the other hand, when the control unit 52 determines that the temperature of the engine cooling water is lower than the predetermined temperature, the operation of the refrigerant pump 130 is stopped by stopping the electric motor 120A to thereby stop the operation of the Rankine cycle 30. A proper hysteresis is given to the determination for the temperature of the engine cooling water, in order to prevent any hunting phenomenon of on-off operation of the Rankine cycle 30.

During the operation of the Rankine cycle 30, the shaft 401 is driven by the electric motor 120B to operate the refrigerant pump 130. The ring shaped piston 405 is rotated around the shaft with the orbital motion within the cylinder chamber 480, wherein the piston 405 slides with the crank portion (crank shaft) 411. The refrigerant is thereby sucked into the cylinder chamber (the pump chamber) 480 through the inlet port 442 and the suction passage 481, pressurized therein, and pumped out to the heating device 31 through the discharge passage 482, the check valve 417, the discharge chamber 470, and the discharge port 471.

During the above operation, the refrigerant leaked from the pump chamber to the spaces between the axial side surfaces 450 of the ring shaped piston 405 and the front housing 403 as well as the rear housing 404 does flow not into the oil storing chamber 410, but into the grooves 451, 453 of the pump suction pressure (i.e. the low pressure). Then, the refrigerant flows to the inlet port 442 through the bypass passage 443.

A part of the lubricating oil leaked from the oil storing chamber 410 to the spaces between the axial side surfaces 450 of the ring shaped piston 405 and the front housing 403 as well as the rear housing 404 does not return to the oil storing chamber 410, but flows into the grooves 451, 453. Then, the lubricating oil further flows to the inlet port 442 through the bypass passage 443.

As above, according to the embodiment, the oil storing chamber 410 is so formed as to cover the sliding portions of the refrigerant pump 130 and the chamber 410 is filled with the oil. The lubrication of the sliding portions is thus assured. Furthermore, the pressure in the oil storing chamber 410 is kept at a value higher than the pump suction pressure, and the grooves 451, 453 are formed at the axial side surfaces 450 of the ring shaped piston 405 and at the outer side of the oil storing chamber 410, wherein the pressure in the grooves 451, 453 is kept at the pressure equal to the pump suction pressure. Accordingly, the refrigerant of low viscosity is prevented from flowing from the pump chamber into the oil storing chamber 410. It is, therefore, avoided that the diluted lubricating oil blocks the formation of the oil film at the sliding portions.

As above, according to the embodiment, since the grooves 451, 453 and the communication hole 452 are formed in the ring shaped piston 405 and the bypass passage 443 is formed in the rear housing 404, the lubrication at the sliding portions can be assured by a simpler structure without increasing the number of parts as well as the number of assembling steps, compared with the conventional pump.

Eleventh Embodiment

Figure 24:
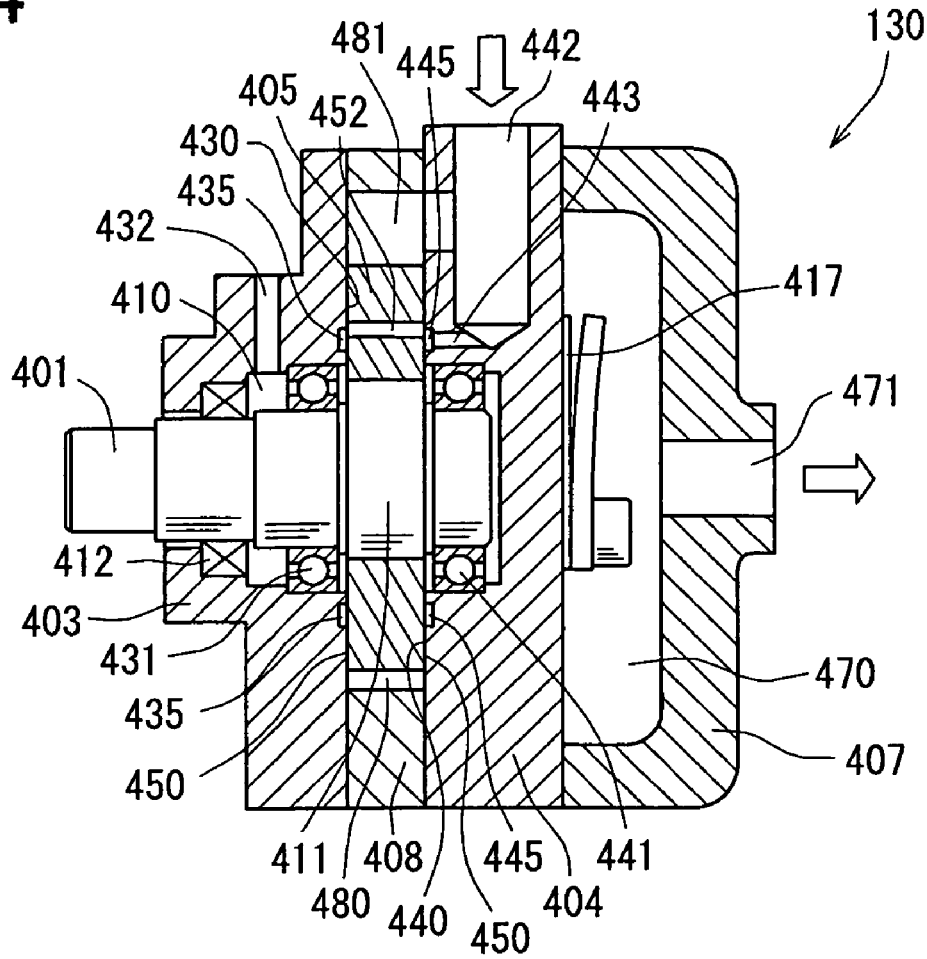
FIG. 24 is a cross sectional view showing a detailed structure of a refrigerant pump of according to an eleventh embodiment.

An eleventh embodiment of the present invention is shown in FIG. 24. In the above tenth embodiment, the grooves 451, 453 are formed at the ring shaped piston 405 of the refrigerant 130. According to the present embodiment, however, grooves 435 and 445 are formed at the front housing 403 and the rear housing 404 of the refrigerant pump 130 (which corresponds to a fluid machine of the present invention). In the embodiment, the groove 435 formed on the front housing 403 corresponds to the small space, the groove portion, and the first space of the present invention. The groove 445 formed on the rear housing 404 corresponds to the small space, the groove portion, and the second space of the present invention.

The communication hole 452, which penetrates the piston 405 in parallel to its axial direction, is formed in the ring shape piston 405, as in the same manner to the above tenth embodiment. The circular grooves 435 and 445 are respectively formed on the end surfaces 430 and 440 of the front housing 403 and the rear housing 404, wherein the grooves 435 and 445 are respectively close to and opposed to the axial side surfaces 450 of the ring shaped piston 405, and the grooves 435 and 445 are formed at such a position corresponding to the communication hole 452. Therefore, the grooves 435 and 445 are communicated with other through the communication hole 452.

The bypass passage 443 is formed in the rear housing 404, as in the same manner to the above tenth embodiment, so that the groove 445 and the inlet port 442 are communicated with each other. According to the above structure, the pressure at the grooves 435 and 445 of the front housing 403 and the rear housing 404 is kept at such pressure (the pump suction pressure) equal to the pressure at the inlet port 442.

The structure and operation of the waste heat utilizing apparatus of the present invention is the same to that of the above tenth embodiment, except for the structure and operation for the refrigerant pump 130. Accordingly, the oil separated from the refrigerant at the separator 35, which is provided at the outlet side of the expansion device 110 for the Rankine cycle 30, is supplied to the oil storing chamber 410 through the oil supply port 432 of the refrigerant pump 130 via the oil supply passage 460.

The pressure in the oil storing chamber 410 is maintained at a higher value by pressure loss at the condensing device 32 and the receiver 33, compared with the pressure (the pump suction pressure) in the inlet port 442, to which the refrigerant is supplied after having passed through the condensing device 32 and the receiver 33.

As above, according to the embodiment, the oil storing chamber 410 is so formed as to cover the sliding portions of the refrigerant pump 130 and the chamber 410 is filled with the oil. The pressure in the oil storing chamber 410 is kept at a value higher than the pump suction pressure, and the grooves 435 and 445 are formed at the end surfaces 430 and 440 of the cylinder chamber 480, wherein the pressure in the grooves 435 and 445 is kept at the pressure equal to the pump suction pressure. As a result, the lubrication of the sliding portions is assured by a simpler structure.

Twelfth Embodiment

Figure 25:
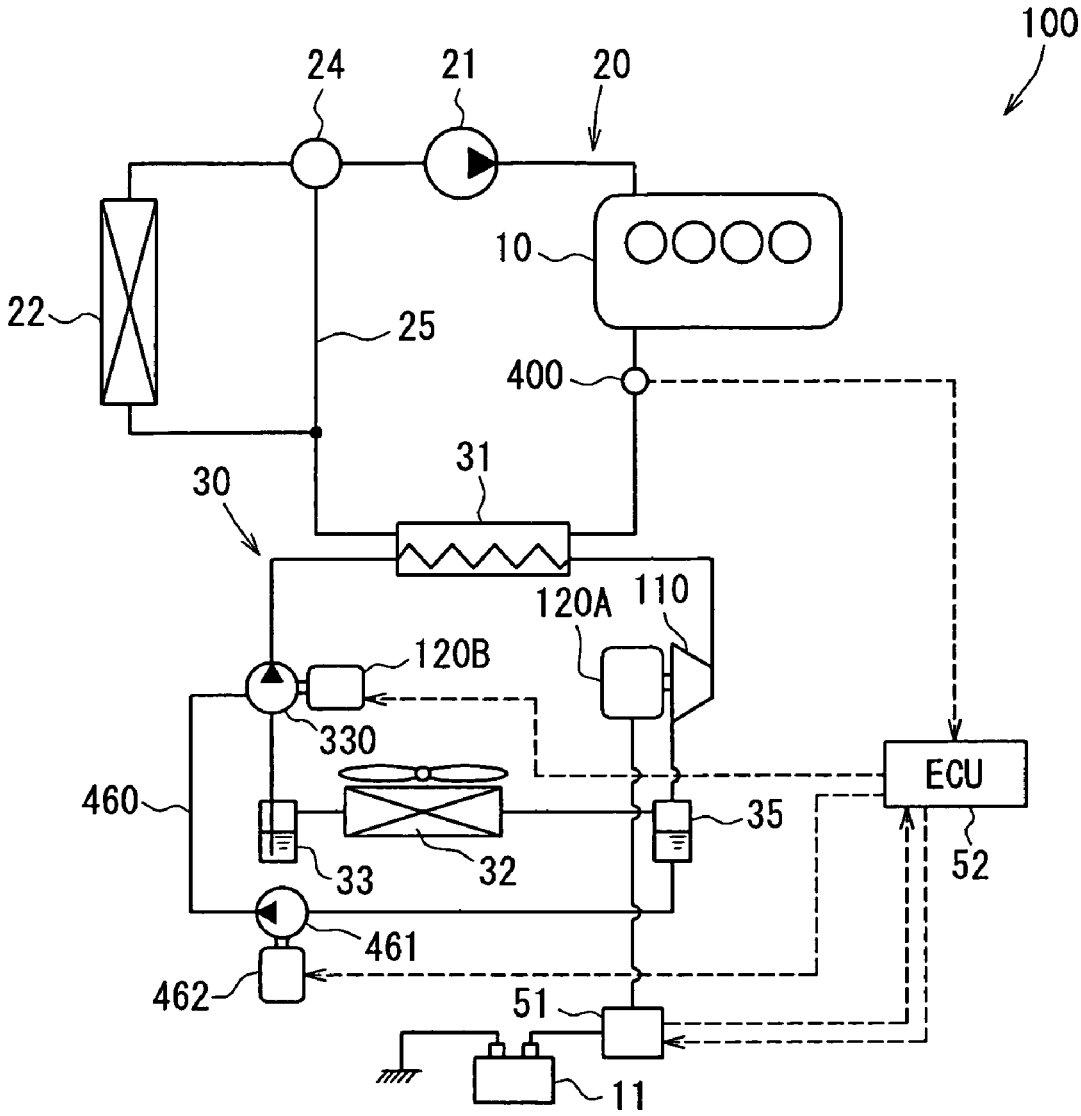
FIG. 25 is a schematic view showing an entire structure of a waste heat utilizing system according to a twelfth embodiment of the present invention.

A twelfth embodiment of the present invention is shown in FIG. 25. According to the present embodiment, an oil supply pump 461 is additionally provided to the oil supply passage 460 for the Rankine cycle 30, compared with the waste heat utilizing apparatus 100 of the above tenth embodiment.

The oil supply pump 461 is an electric type pump, which is driven by an electric motor 462, the operation of which is controlled by the control unit 52. When starting the Rankine cycle 30, the electric motor 462 is driven to operate the oil supply pump 461. Then, the oil separated from refrigerant at the separator 35 is pressurized and supplied into the oil storing chamber 410 of the refrigerant pump 130 through the oil supply port 432.

The structure and operation of the waste heat utilizing apparatus 100 as well as the refrigerant pump 130 of the present invention is the same to that of the above tenth embodiment, except for the above structure and operation.

As above, according to the present embodiment, the oil supply pump 461 is provided in the oil supply passage 460. The pressure in the oil storing chamber 410 is kept at a higher value, compared with the tenth embodiment, so that a pressure difference is made larger between the pressure of the oil storing chamber 410 and the pressure in the grooves 451 and 453 formed on the axial side surfaces 450 of the ring shaped piston 405, in which the pressure is maintained at the pump suction pressure. As a result, the refrigerant of low viscosity is surely prevented from flowing from the pump chamber into the oil storing chamber 410, to assure the lubrication at the sliding portions.

Thirteenth Embodiment

Figure 26:
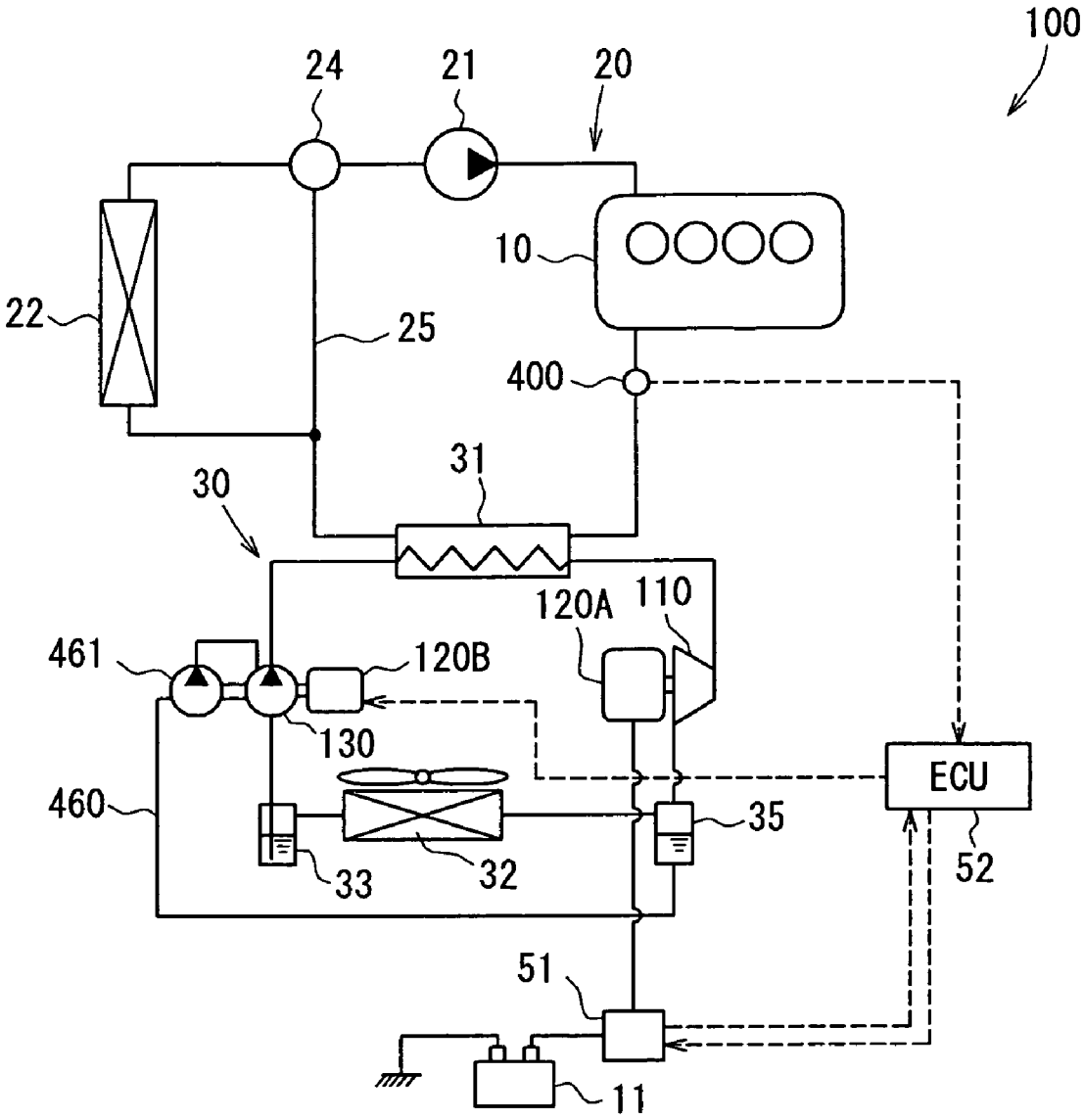
FIG. 26 is a schematic view showing an entire structure of a waste heat utilizing system according to a thirteenth embodiment of the present invention.

A thirteenth embodiment of the present invention is shown in FIG. 26. In the above twelfth embodiment, the oil supply pump 461 is driven by the exclusive electric motor 462. According to the present embodiment, however, the driving source for the refrigerant pump 130 for circulating the refrigerant in the Rankine cycle 30 is commonly used. The oil supply pump 461 is driven by the electric motor 120B, which drives the refrigerant pump 130.

The structure and operation of the waste heat utilizing apparatus 100 as well as the refrigerant pump 130 of the present embodiment is the same to that of the above twelfth embodiment, except for the above structure and operation.

As above, according to the present embodiment, the electric motor 120B is commonly used as the driving source for the refrigerant pump 130 for the Rankine cycle 30 and for the oil supply pump 461 in the oil supply passage 460. Therefore, the structure is made simpler compared with the twelfth embodiment.

Fourteenth Embodiment

Figure 27:
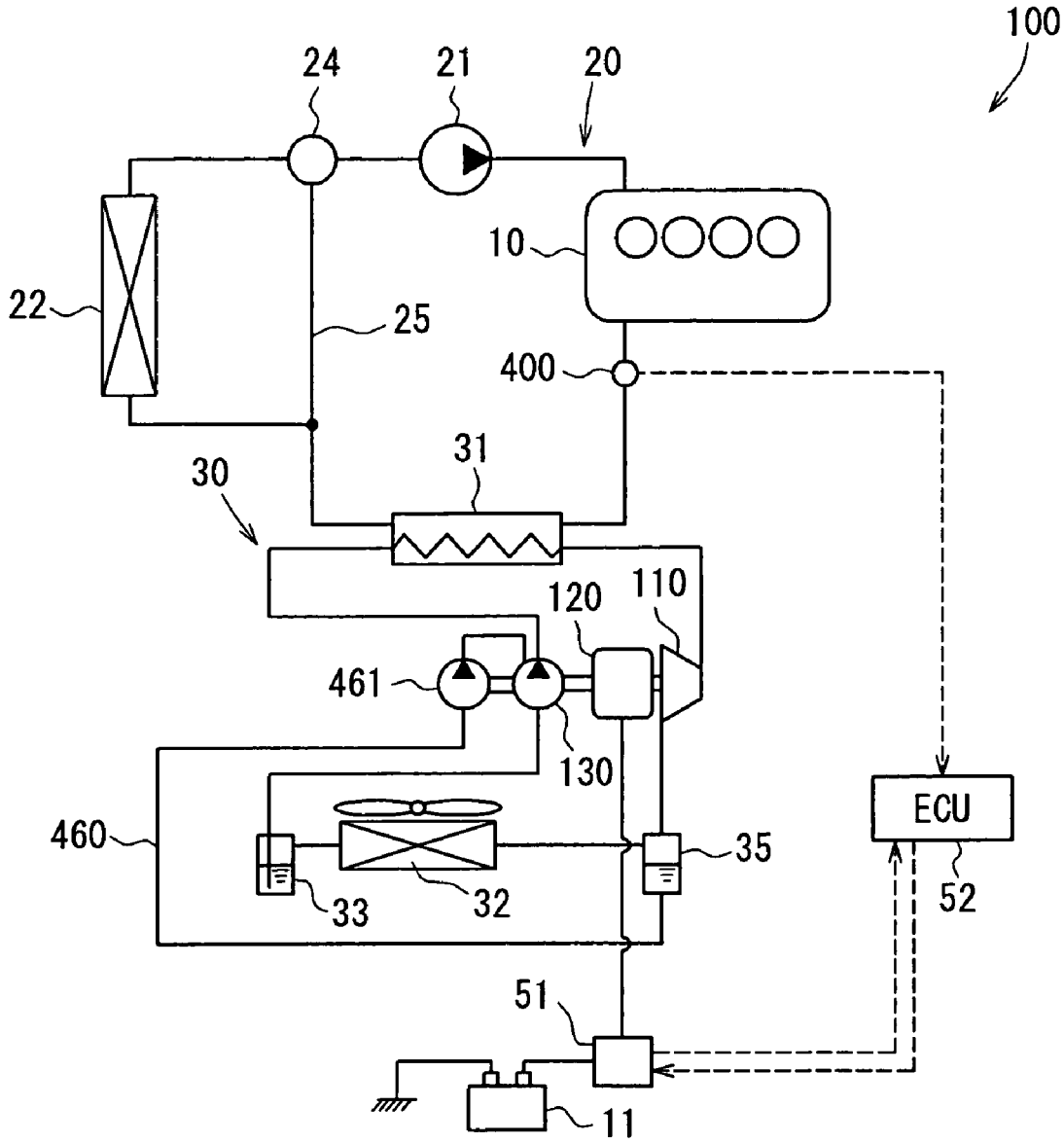
FIG. 27 is a schematic view showing an entire structure of a waste heat utilizing system according to a fourteenth embodiment of the present invention.

A fourteenth embodiment of the present invention is shown in FIG. 27. In the above thirteenth embodiment, the electric motor 120B is formed as the driving source for the refrigerant pump 130 for the Rankine cycle 30 and for the oil supply pump 461 in the oil supply passage 460. According to the present embodiment, however, the motor generator 120 (which corresponds to an external driving source) having the function of the electric power generator is connected to the expansion device 110. The refrigerant pump 130 and the oil supply pump 461 are connected to the motor generator 120 at the opposite side of the expansion device 110. The refrigerant pump 130 and the oil supply pump 461 are driven by the motor generator 120, when the motor generator 120 is operated as the electric motor.

The operation of the motor generator 120 is controlled by the control unit 52 via the control circuit 51. The control unit 52 operates at first the motor generator 120 as the electric motor when starting the Rankine cycle 30, so as to drive the refrigerant pump 130 and the oil supply pump 461.

And when a sufficient amount of the waste heat can be obtained from the engine 10, and when the rotational driving force generated at the expansion device 110 becomes larger than the driving force for the refrigerant pump 130 as well as the oil supply pump 461, the motor generator 120 is operated as the electric power generator, to generate the electric power.

The structure and operation of the waste heat utilizing apparatus 100 as well as the refrigerant pump 130 of the present embodiment is the same to that of the above thirteenth embodiment, except for the above structure and operation.

As above, according to the present embodiment, the motor generator 120 connected to the expansion device 110 is used as the driving source for the refrigerant pump 130 of the Rankine cycle 30 and for the oil supply pump 461 of the oil supply passage 460. The structure is made much simpler compared with the thirteenth embodiment. And the energy for driving the refrigerant pump 130 and the oil supply pump 461 is reduced.

(Other Modifications)

The refrigerant pump 130 for the Rankine cycle 30, which is identical to that for the tenth embodiment, is used in the above twelfth, the thirteenth, and the fourteenth embodiments. However, the refrigerant pump having the same structure to the eleventh embodiment may be used.

In the above embodiments, the grooves 451, 453, 435, 445 formed on the axial side surfaces 450 of the ring shaped piston 405 or formed on the end surfaces 430, 440 of the cylinder chamber 480 are made as circular shape. However, the shape of the grooves 451, 453, 435, 445 may not be limited to the circular form but may be formed as any other forms, for example as the elliptic form, with which the grooves may receive the refrigerant in any directions leaked from the pump chamber to the spaces between the axial side surfaces 450 and the end surfaces 430 and 440.

In the above embodiments, the oil storing chamber 410 is so formed as to cover the bearing 431 on the side of the front housing 403 and the bearing 441 on the side of the rear housing 404. However, it may be so structured that the bearing 431 on the side of the front housing 403 is not covered by the oil storing chamber 410. In such a modification, the oil storing chamber 410 is so structured as to cover the sliding portion between the crank portion 411 and the ring shaped piston 405 and the bearing 441 on the side of the rear housing 404. In addition, a seal member is provided at an outer periphery of the shaft 401 between the ring shaped piston 405 and the bearing 431 on the front housing 403.

In the above embodiments, the rolling piston type pump is applied to the present invention. However, a Kinney type pump, which has an oscillating piston instead of the vane 414 defining the space of the suction side and the space of the discharging side, a vane type pump having blades which are rotated together with the ring shaped piston, or any other rotary type pumps may be applied to the present invention. The present invention may be further applied to rotary type compressors other than the pump.

In the above embodiments, the Rankine cycle may be so formed that the condensing device 32 and the receiver 33 may be commonly used not only for the Rankine cycle 30 but for the refrigerating cycle.

In the above embodiments, the present invention is applied to the refrigerant pump 130, which circulates the refrigerant in the Rankine cycle for the waste heat utilizing apparatus to be mounted on the vehicle. The waste heat utilizing apparatus may not be limited to the ones for the vehicle. The heat source for supplying the waste heat to the heating device 31 is not limited to the engine (the internal combustion engine) 10. Any other devices, such as an external combustion engine, stacks for the fuel cells of a fuel-cell car, various kinds of motors, the inverters, and the like, which generates heat during its operation and throws away a part of the heat (i.e. the waste heat) for the purpose of controlling the temperature, may be used. In any of the above cases, the source for the heating device 31 is working fluid for cooling the devices having the waste heat.

In the above embodiments, the lubricating oil is supplied from the outside of the refrigerant pump 130 into the oil storing chamber 410 through the oil supply port 432. It is, however, so modified that the oil pooling portion is provided in the fluid machine (in the pump or the compressor) and the lubricating oil is supplied from the oil pooling portion to the oil storing chamber 410. In such a modification, the oil separated at the outlet side is pooled in the oil pooling portion formed in the housing, and the lubricating oil may be supplied to the oil storing chamber 410 by an exclusive pump.

The present invention is preferably applied to the fluid machine, like the refrigerant pump for the Rankine cycle 30 according to the above embodiments, which is operated under a relatively high load and discharges the working fluid. The present invention may be applied, other than the refrigerant pump 130 for the Rankine cycle 30, to a refrigerant pump for circulating refrigerant in a refrigerating cycle of a thermal storage type air conditioning system, which stores ice or hot water in a storing tank by use of night time electric power and utilizes it for the air conditioning operation in the day time.

Fifteenth Embodiment

Figure 28:
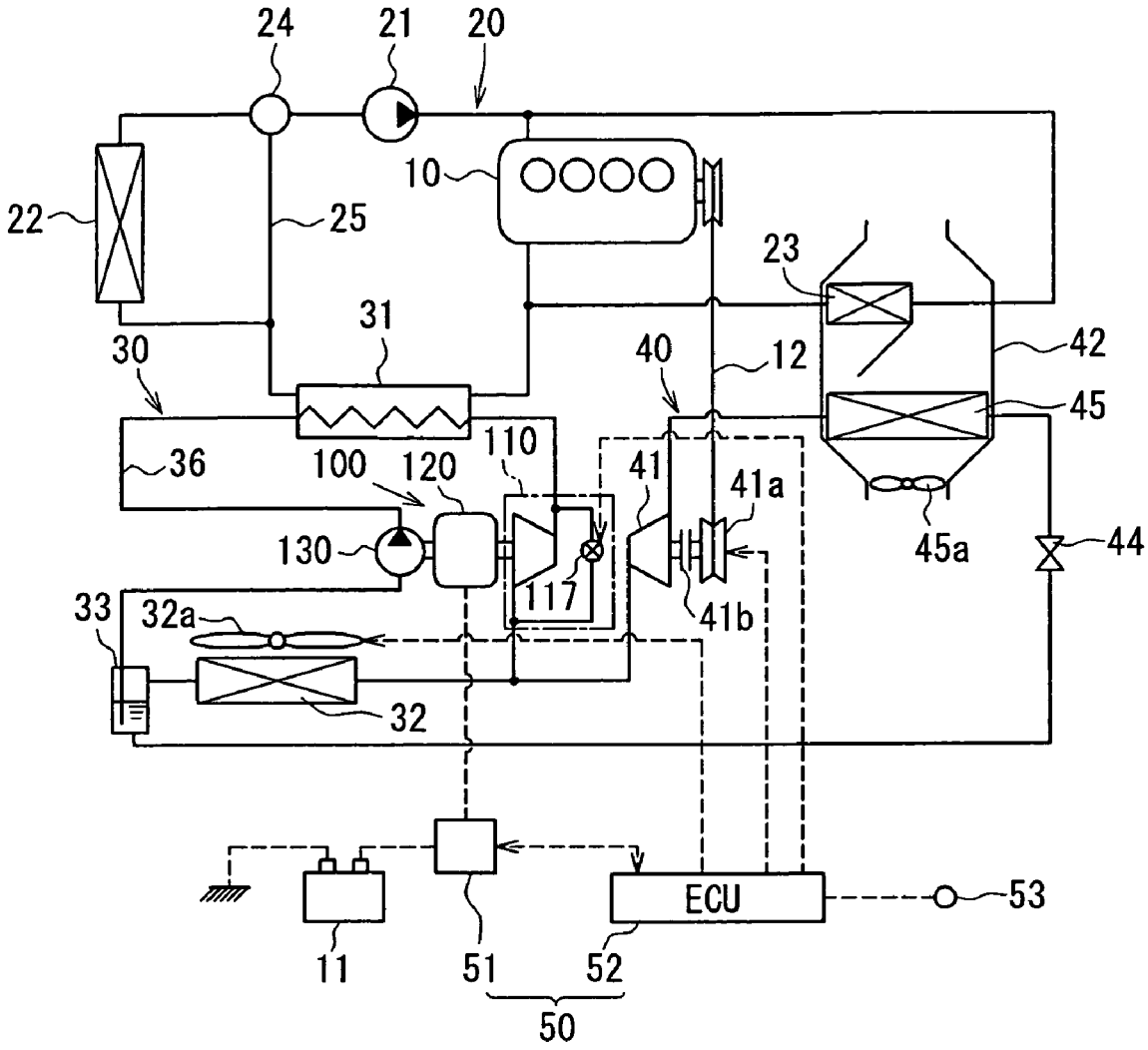
FIG. 28 is a schematic view showing a system structure according to a fifteenth embodiment of the present invention.

According to the pump-expansion-generator device 100 of the present embodiment, the expansion device 110, the motor generator 120 for the electric motor and the electric power generator, and the refrigerant pump 130 are likewise integrally formed. A structure of the whole system will be explained with reference to FIG. 28. The present embodiment is similar to the system structure shown in FIG. 15, and different points will be explained.

The control unit 52 controls not only the operation of the inverter 51 but also the operations of an electromagnetic clutch 41*b*, a fan 32*a*, the pressure equalizing valve 117 of the expansion device 110, and so on, when starting the refrigerating cycle 40 and the Rankine cycle 30. A power supply switch 53 (e.g. an ignition switch) is connected to the control unit 52. When the power supply switch 53 is turned off, the power supply from the battery 11 is cut off, so that the operations of the control unit 52 as well as the inverter 51, the refrigerating cycle 40 and the Rankine cycle 30 are stopped.

Next, a structure of the pump-expansion-generator device 100 will be explained with reference to FIG. 29. In the pump-expansion-generator device 100, the expansion device 110, the motor generator 120, and the refrigerant pump 130 are coaxially connected and integrally formed.

The pump-expansion-generator device 100 of FIG. 29 has a similar structure to that of the pump-expansion-generator device 100 of FIG. 16, but differs from the pump-expansion-generator device 100 of FIG. 16 in the following points.

Figure 29:
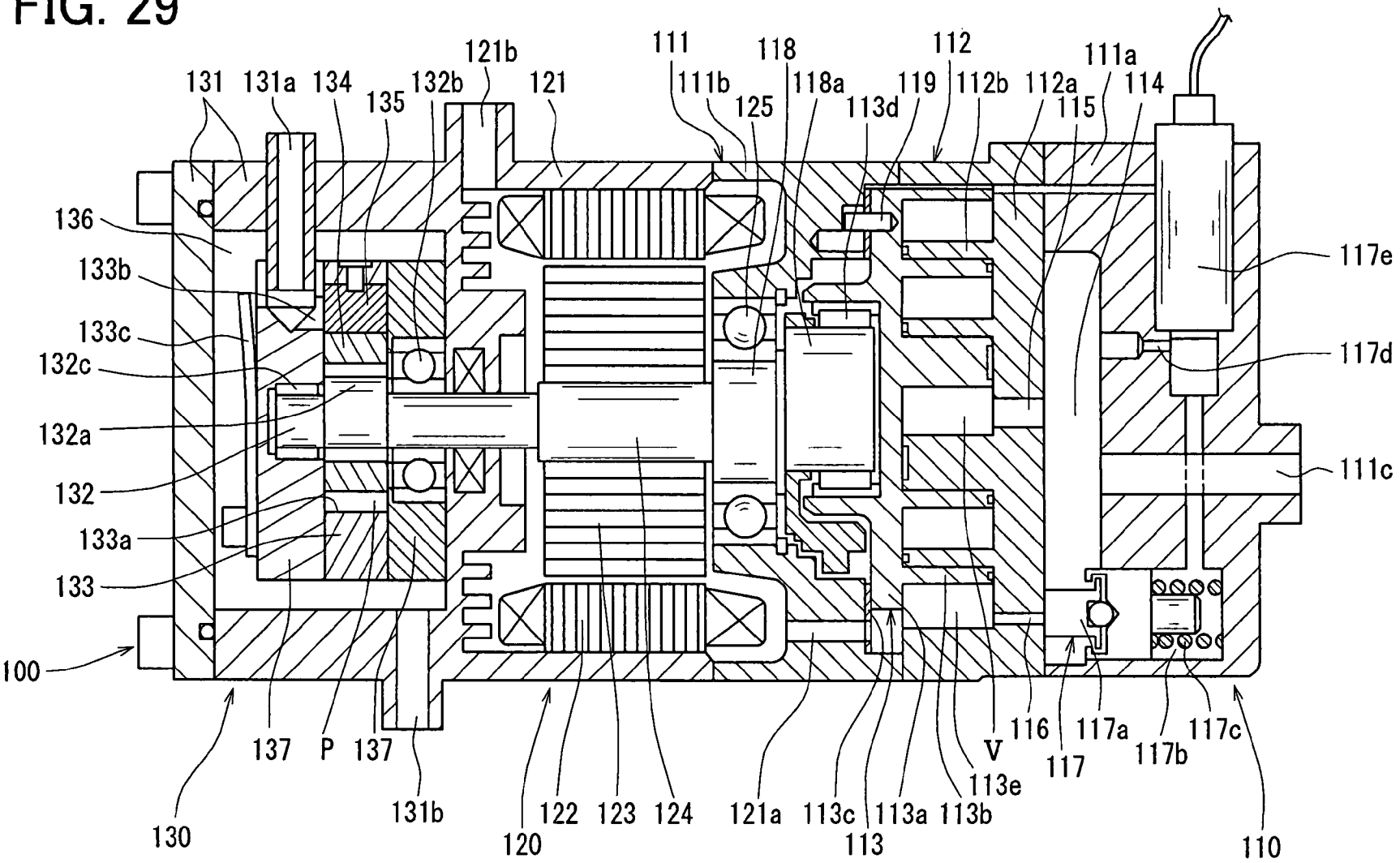
FIG. 29 is a cross sectional view showing a fluid machine (an integrated machine of a refrigerant pump, an expansion device and an electric power generating device) according to the fifteenth embodiment of the present invention.

Namely, in the pump-expansion-generator device 100 of FIG. 29, the expansion device 110, the motor generator 120, and the refrigerant pump 130 are arranged not in the vertical direction but in the horizontal direction. And the pump-expansion-generator device 100 of FIG. 29 does not have a structure corresponding to the oil pooling portion 101 and the discharged gas passage 121*a* of the pump-expansion-generator device 100 of FIG. 16

Figure 30:
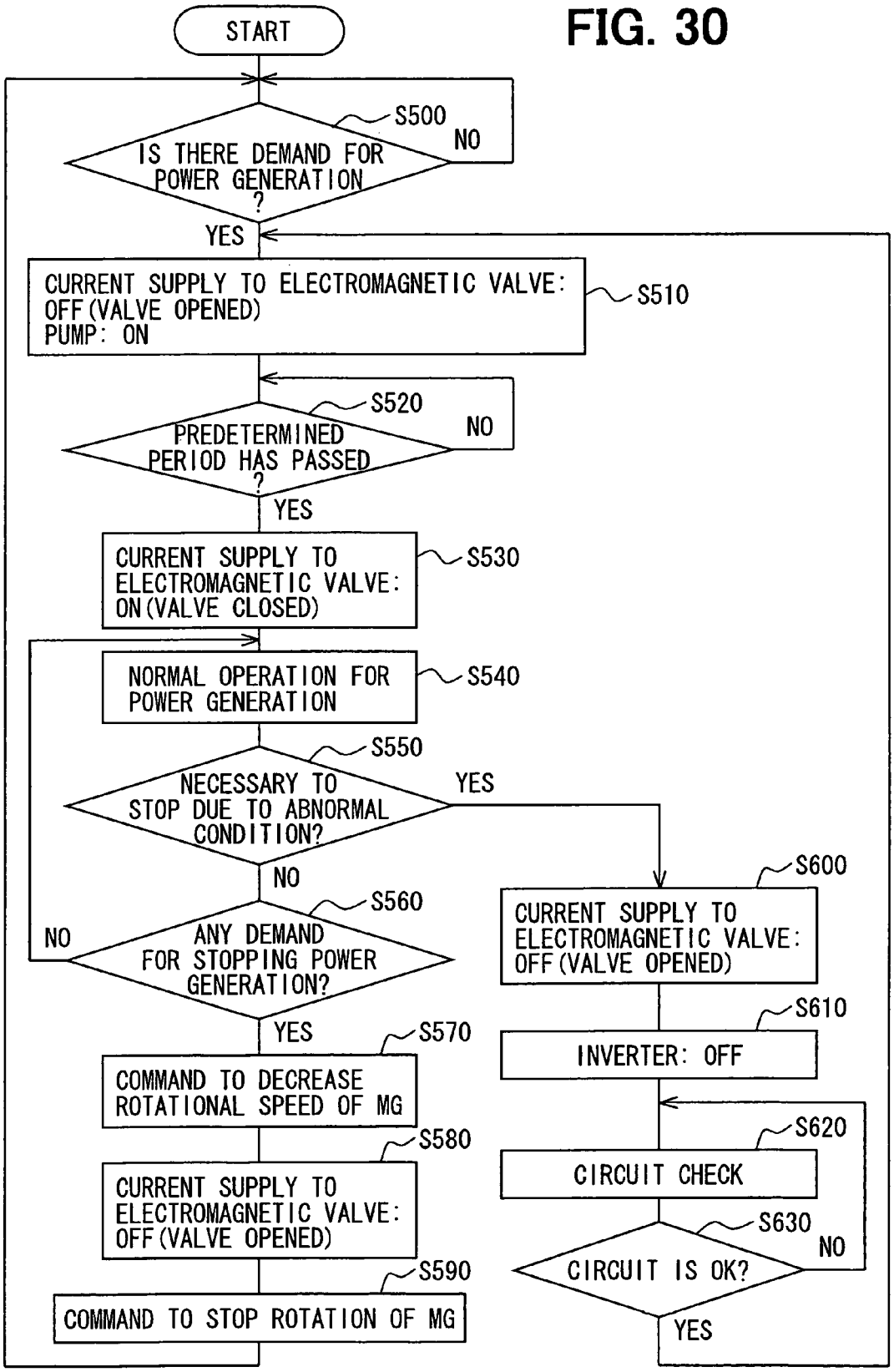
FIG. 30 is a flowchart for controlling an operation of Rankine cycle according to the fifteenth embodiment.

An operation (a control) of the pump-expansion-generator device 100 according to the present embodiment will be explained with reference to a flowchart shown in FIG. 30.

At first, the control unit 52 determines at a step S500 whether there is a demand for electric power generation. The determination for the demand of the electric power generation is made based on a charged condition of the battery 11, which is detected by the inverter 51. The control unit 52 determines that there is the demand of the electric power generation, when the current charged amount is lower than a predetermined charged amount. When the control unit 52 determines at the step S500 that there is the demand of the electric power generation, the control unit 52 cuts off the power supply to the electromagnetic valve 117*e* at a step S510, so that the electromagnetic valve 117*e* is opened to open the communication port 116 by moving the valve body 117*a* toward the back pressure chamber 117*b*. The motor generator 120 is operated as the electric motor. The refrigerant pump 130 and the expansion device 110 are driven by the motor generator 120 to start up the operation of the Rankine cycle 30.

In this operation, the refrigerant is sucked by the refrigerant pump 130 from the gas-liquid separator 33, pressurized and supplied to the heating device 31, and the refrigerant discharged from the heating device 31 is supplied to the expansion device 110. Since the communication port 116 is kept opened in this operation, the refrigerant bypasses the working chamber V and directly flows into the low pressure chamber 113*e* from the high pressure chamber 114. Then, the refrigerant flows through the inside of the motor housing 121 and discharged from the low pressure port 121*b*. The refrigerant further flows to the gas-liquid separator 33 through the condensing device 32.

When a predetermined time period has passed by from the step S510 (i.e. when it is determined as YES at a step S520), the electric power is supplied to the electromagnetic valve 117*e* at a step S530, so that the electromagnetic valve 117*e* is closed to close the communication port 116 by moving the valve body 117*a* toward the base plate 112*a*. The above predetermined time period is such a predetermined time period, during which the refrigerant is sufficiently heated by the heating device 31 to become the super heated steam of the refrigerant, even when the temperature of the engine cooling water is low.

When the communication port 116 is closed, the refrigerant supplied into the expansion device 110 flows through the high pressure chamber 114, the inlet port 115, the working chamber V, and the low pressure chamber 113*e*.

At a step S540, a normal operation for the electric power generation by the Rankine cycle 30 is carried out. Namely, the super heated steam of the refrigerant, which is heated by the heating device 31 to the high temperature and high pressure refrigerant, is introduced into and expanded in the working chamber V of the expansion device 110. When the movable scroll 113 is rotated by the expansion of the super heated steam of the refrigerant, the motor generator 120 and the refrigerant pump 120 connected to the movable scroll 113 are driven to rotate. When the driving rotational force of the expansion device 110 becomes larger than the driving force necessary for driving the refrigerant pump 130, the motor generator 120 is operated as the electric power generator and the control unit 52 controls the inverter 51 such that the electric power generated at the motor generator 120 is charged into the battery 11 via the inverter 51. The refrigerant, which has been expanded in the expansion device 110 and the pressure of which is decreased, is circulated through the condensing device 32, the gas-liquid separator 33, the bypass passage 36, the refrigerant pump 130, the heating device 31, and to the expansion device 110 (circulated in the Rankine cycle 30).

In the above normal operation for the electric power generation by the step S540, the control unit 52 determines at a step S550 whether there is any abnormal condition. Examples of the abnormal conditions are an abnormal rotation in which it is incapable to detect the position of the motor generator 120 by the inverter 51, a situation in which the control of the motor generator 120 is not possible due to a malfunction of the inverter 51 itself, or the like.

When the control unit 52 determines at the step S550 that there is no abnormal condition, the normal operation for the electric power generation is continued. And at a step S560, the control unit 52 determines whether there is a demand for stopping the electric power generation. When the battery 11 is fully charged by the normal operation for the electric power generation, there is no need to continue the electric power generation. The process goes to a step S570, because the electric power generation is not necessary and the operation of the Rankine cycle must be stopped. When the charged amount in the battery is not full, the process goes back to the step 540.

At the step S570, the rotational speed of the motor generator 120 is decreased for the purpose of stopping the Rankine cycle 30. At a step S580, the current supply to the electromagnetic valve 117*e* is cut off in order that the electromagnetic valve 117*e* is opened to open the communication port 116 by moving the valve body 117*a* toward the back pressure chamber 117*b*. In this operation, the refrigerant supplied to the expansion device 110 flows through the communication port 116, so that the expanding operation of the refrigerant in the working chamber V is avoided. At a step 590, the operation of the motor generator 120 is completely stopped, and the process goes back to the step S500.

When the control unit 52 determines at the step S550 that there is the abnormal condition, an operation (i.e. an operation for emergency shut down) for quickly stopping the Rankine cycle 30 is carried out by steps S600 to S630.

Namely, at the step S600, the current supply to the electromagnetic valve 117*e* is cut off so that the electromagnetic valve 117*e* is opened to open the communication port 116 by moving the valve body 117*a* toward the back pressure chamber 117*b*. Accordingly, the refrigerant supplied to the expansion device 110 flows through the communication port 116, so that the expanding operation of the refrigerant in the working chamber V is avoided.

At the step S610, the operation of the inverter 51 is stopped to stop the motor generator 120 (and the expansion device 110, and the refrigerant pump 130). At the step S620, a circuit check for the inverter 51 is carried out. When a result for the circuit check is OK at the step S630, the process goes back to the step S510.

The control unit 52 connects the pulley 41*a* with the compressor 41 by the electromagnetic clutch 41*b*, when there is a demand by the vehicle passenger for the air conditioning operation, so that the compressor 41 is driven by the driving force of the engine 10 to carry out the air conditioning operation by the refrigerating cycle 40. A number of rotational speed of the fan 32*a* is controlled for the purpose of adjusting the condensing performance of the condensing device 32.

As above, according to the present embodiment, the communication port 116 for directly communicating the high pressure chamber 114 with the low pressure chamber 113*e*, and the pressure equalizing valve 117 for opening and closing the communication port 116 are provided. Accordingly, it becomes possible in the expansion device 110 that the refrigerant bypasses the working chamber V, by opening the pressure equalizing valve 117 according to the necessity. In this embodiment, an external pipe arrangement is not necessary for the expansion device 110 and it is more advantageous for the expansion device 110 in mounting steps and cost, because the communication port 116 and the pressure equalizing valve 117 are provided in the housing 111 for the expansion device.

With the structure of the communication port 116 and the pressure equalizing valve 117, the pressures in the high pressure side and the low pressure side are easily equalized by opening the communication port 116, when it is necessary to normally or quickly stop the expansion device 110 during the operation of the Rankine cycle 30. Then, since the expansion of the refrigerant in the working chamber V can be avoided, the operation of the expansion device 110 can be safely and surely stopped.

When it is intended to stop the expansion device 110 before opening the pressure equalizing valve 117, the expansion device 110 may be suddenly operated under smaller load and at a higher rotational speed. Then, it would be difficult to stop the expansion device 110. According to the present embodiment, however, the operation of the expansion device 11 is stopped after the pressures in the high pressure side and the low pressure side of the Rankine cycle 30 are equalized by opening the pressure equalizing valve 117. Therefore, the above operation at the high rotational speed is prevented and the operation of the expansion device 110 can be safely and surely stopped.

In addition, the pressure equalizing valve 117 is closed after a predetermined time period has passed by from its opening, at the start up of the Rankine cycle 30. The refrigerant in the heating device 31 is in the liquid-phase, as the case may be, at the start up of the Rankine cycle 30 (in particular, when the Rankine cycle 30 is started for the first time since the vehicle running). Even when the refrigerant of the liquid-phase is supplied to the expansion device 110, the expansion work can not be obtained from the working chamber V. Accordingly, the liquid-phase refrigerant is prevented from flowing from the heating device 31 into the working chamber V, by opening the pressure equalizing valve 117 during the predetermined time period. When the pressure equalizing valve 117 is closed after the predetermined time period, during which the refrigerant is sufficiently heated at the heating device 31 to become the super heated steam, so that the super heated steam can be introduced into the working chamber V to operate the expansion device 110 as its original expansion device.

Furthermore, when the lubricating oil is mixed with the refrigerant, the viscosity of the lubricating oil is low in the case that the refrigerant is in a low temperature and in the liquid-phase. Therefore, the primary lubricating effect can not be obtained. Accordingly, any problem for the wear at the sliding portions, which may occur due to a shortage of the lubricating oil, can be avoided by prohibiting the flow-in of the liquid-phase refrigerant into the working chamber V during the predetermined time period after the start up of the Rankine cycle 30.

Furthermore, the electric power generation can be more effectively carried out, when the heating performance of the heating device 31 (e.g. the temperature of the engine cooling water) is detected at the start up of the Rankine cycle 30, and the on-off control of the pressure equalizing valve 117 is carried out (the steps S510 to S530) when the heating performance is lower than a predetermined level.

The communication port 116 is formed in the base plate 112*a*, which partitions the high pressure chamber 114 and the working chamber V (the low pressure chamber 113*e*). Therefore, the port 116 can be easily formed.

The pressure equalizing valve 117 is composed of the valve body 117*a*, the back pressure chamber 117*b*, the spring 117*c*, the orifice 117*d*, and the electromagnetic valve 117*e*. Accordingly, the on-off device can be easily formed.

Figure 31A:
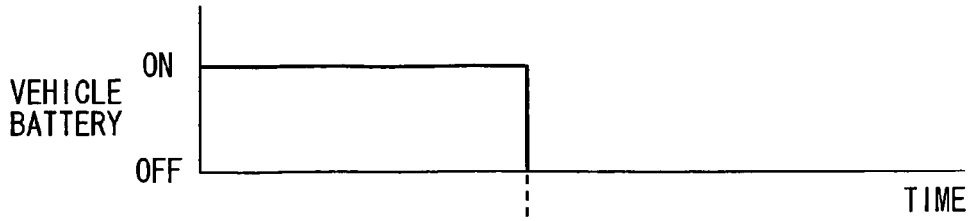
FIGS. 31A to 31D are time charts showing operation of an electromagnetic valve and a motor-generator according to the fifteenth embodiment, when current supply to the system is cut off.
Figure 31B:
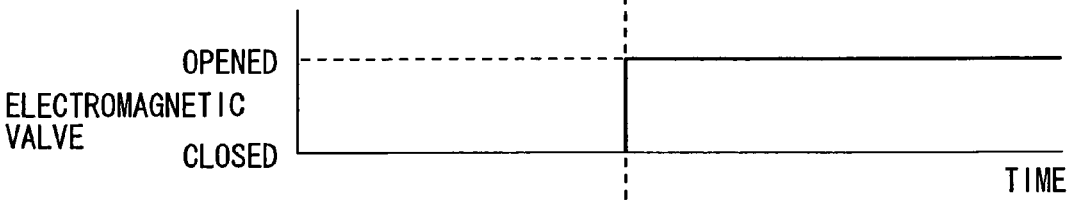
Figure 31C:
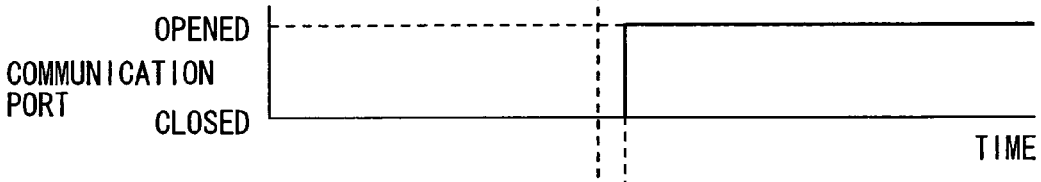
Figure 31D:
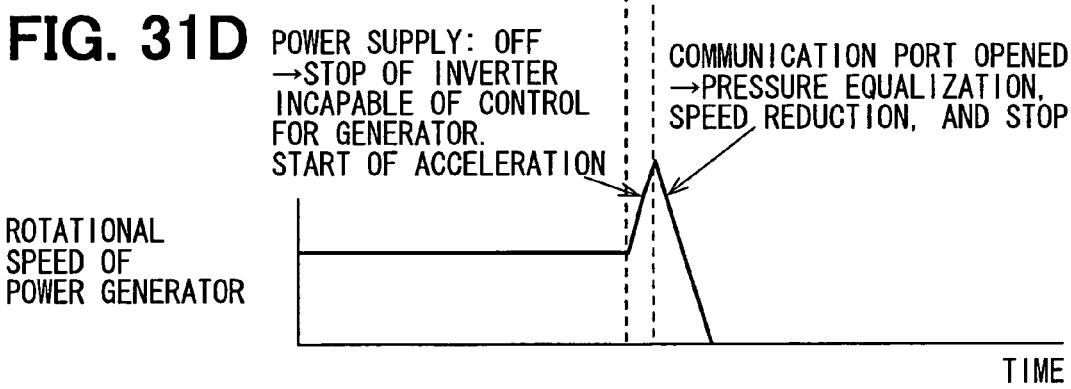

The pressure equalizing valve 117 (the electromagnetic valve 117*e*) is designed such that the valve is opened when the current supply is cut off. Accordingly, the expansion device 110 can be safely and surely stopped, when the current supply is cut off due to the abnormal condition. As shown in FIGS. 31A to 31D, in the case (FIG. 31A) that the current supply is cut off during the operation of the Rankine cycle 30, due to any abnormal conditions or turn-off of the power supply switch (the ignition switch) 53 by the passenger, the motor generator 120 is stopped and the electromagnetic valve 117*e* is opened (FIG. 31B) as a result of the cut-off of the current supply to the electromagnetic valve 117*e*, and the communication port 116 is opened with a certain time lag (FIG. 31C). The load of the expansion device 110 is rapidly lightened in accordance with the stop of the motor generator 120. The rotational speed is thereby moved toward the higher speed side for a moment (FIG. 31D). However, the expansion device 110 is reduced in its rotational speed to safely and surely stop the operation of the expansion device 110, because the expanding operation of the refrigerant in the working chamber V is avoided by opening the communication port 116.

The inside space of the motor generator 120 (the motor housing 121) and the low pressure chamber 113*e* are communicated with each other through the discharged gas passage 121*a*, so that the refrigerant flows from the high pressure chamber 114 to the inside space of the motor generator 120 through the low pressure chamber 113*e*, when the pressure equalizing valve 117 is opened. Accordingly, the inside space of the motor generator 120 operates as an accumulator to decrease pulsation, which is generated in accordance with the on-off operation of the pressure equalizing valve 117. Noise caused by the pressure pulsation is thereby decreased.

(Other Modifications)

In the above embodiment, the pressure equalizing valve 117 is formed as the valve body 117*a*, which opens or closes the communication port 116 in accordance with the on-off operation of the electromagnetic valve 117*e*. The pressure equalizing valve 117 is not limited to the valve of the above type, but may be formed as an electromagnetic valve which directly opens or closes the communication port 116.

In the above embodiment, the rotational driving force obtained from the expansion device 110 is used to operate the motor generator 120, so that the electric energy is charged into the battery 11. However, the energy obtained by the expansion device may be charged as energy of movement in a flywheel, or as kinetic energy such as elastic potential energy in the spring.

In the above embodiment, the refrigerant pump 130 is connected to the expansion device 110. However, the above two components are separated from each other, and the refrigerant pump 130 may be driven by an exclusive electric motor.

In addition, in the above embodiment, the expansion device 110 is formed by the scroll type device and the refrigerant pump 130 is formed by the rolling piston type device. However, the present invention may not be limited to those types. A gear pump type, a trochoid type, or any other types may be used.

In the above embodiment, the refrigerating cycle 40 is provided to the Rankine cycle 30. However, the present invention may be applied to the waste heat utilizing apparatus having only the Rankine cycle 30.

Any device, which generates heat for its operation and throws away a part of the heat for the purpose of its temperature control (i.e. which generates waste heat), such as an external combustion engine, fuel cell stacks for a fuel cell car, various kinds of motors, and the inverter, can be widely used as the heating source for the heating device 31, other than the engine 10. In any of the above cases, the source for the heating device 31 is working fluid for cooling the devices having the waste heat.

What is claimed is:

1. A fluid machine comprising:

an expansion device for generating a driving force by expansion of working fluid, the working fluid includes lubricating oil and is heated to a gas-phase condition;

an electric power generator having a rotor driven by the driving force of the expansion device to generate electric power when the rotor is rotated;

an oil pooling portion provided in a passage, through which the working fluid discharged from the expansion device flows, the pooling portion pooling the lubricating oil contained in the working fluid such that the lubricating oil is in contact with at least one of a sliding portion of the expansion device and a sliding portion of the electric power generator; and a heating unit heating the working fluid in the oil pooling portion; wherein electric current is supplied to the heating unit so as to heat the working fluid in the oil pooling portion when viscosity of the lubricating oil is lower than a predetermined value, while the rotor of the electric power generator is maintained at a stopped condition.

2. A fluid machine according to claim 1, wherein the heating unit is operated at starting up of the expansion device.

3. A fluid machine according to claim 1, wherein the heating unit is operated during a normal operation of the expansion device.

4. A fluid machine according to claim 1, wherein the heating unit comprises a stator of the electric power generator, wherein the stator generates the heat when electric current is supplied to the stator in such a manner that a power factor is decreased.

5. A fluid machine according to claim 1, wherein the heating unit comprises a fluid passage, through which heat medium flows from an external high temperature source.

6. A fluid machine according to claim 1, wherein the heating unit comprises an electric heating device.

7. A fluid machine according to claim 4, wherein:

the supply of the electric current to the heating unit is cut off when the viscosity of the lubricating oil becomes higher than the predetermined value, so that the expansion device starts its operation to thereby generate electric power at the electric power generator.

8. A fluid machine according to claim 1, wherein the heating unit heats the working fluid while the working fluid is in the oil pooling portion.

9. A fluid machine according to claim 8, wherein the heating unit is disposed within the oil pooling portion.

* * * * *